US007913459B2

(12) United States Patent
Ball et al.

(10) Patent No.: US 7,913,459 B2
(45) Date of Patent: Mar. 29, 2011

(54) WORK SPACE MANAGEMENT SYSTEM

(75) Inventors: Douglas Ball, Senneville (CA); Leon Goldik, Beaconsfield (CA); Jeffrey G. Sokalski, Montreal (CA); Gary C. Smith, Holland, MI (US); Paul Dame, Holland, MI (US); Michael Panse, Holland, MI (US); Joseph T. Iacovoni, Grand Rapids, MI (US); Keith E. Foco, Holland, MI (US); Paul S. Gartland, Holland, MI (US); James E. Moon, Jr., Hudsonville, MI (US); Jeffrey D. Roetman, West Olive, MI (US); Jeffrey L. Clark, Holland, MI (US); Lawrence W. Kallio, III, Grand Haven, MI (US)

(73) Assignee: Herman Miller, Inc., Zeeland, MI (US)

( * ) Notice: Subject to any disclaimer, the term of this patent is extended or adjusted under 35 U.S.C. 154(b) by 1335 days.

(21) Appl. No.: 10/856,130

(22) Filed: May 28, 2004

(65) Prior Publication Data

US 2005/0011138 A1 Jan. 20, 2005

Related U.S. Application Data

(60) Provisional application No. 60/475,061, filed on May 30, 2003.

(51) Int. Cl.
*E04H 1/12* (2006.01)

(52) U.S. Cl. ..... 52/36.1; 52/239

(58) Field of Classification Search ..... 52/239, 52/36.1, 36.2, 36.4, 79.12, 220.7, 284, 285.1, 52/285.41, 285.4, 36.5, 79.2; 160/135; 108/42, 48, 153.1, 157.1, 158.11, 50.01; 248/188.6
See application file for complete search history.

(56) References Cited

U.S. PATENT DOCUMENTS

| | | | | |
|---|---|---|---|---|
| 1,264,227 A | | 4/1918 | Uhl | |
| 2,437,162 A | * | 3/1948 | Keller | 108/48 |
| 2,858,056 A | * | 10/1958 | Ownby | 182/95 |
| 2,975,908 A | | 3/1961 | Huet | |

(Continued)

FOREIGN PATENT DOCUMENTS

CA 1256664 4/1989

(Continued)

OTHER PUBLICATIONS

"Defensive Office Furniture Placement Theory", Posted by Dave: [Retrieved Mar. 4, 2008] retrieved from the Internet: URL: http://www.themeat.org/slacking/chapter4, pp. 1-3 of 4—see p. 2, paragraphs 4 and 5.

(Continued)

*Primary Examiner* — Robert J Canfield
*Assistant Examiner* — Christine T Cajilig
(74) *Attorney, Agent, or Firm* — Brinks Hofer Gilson & Lione

(57) ABSTRACT

A work space system including a plurality of work areas. A work area includes a spine wall, a first wall adjacent to the spine wall and extending from the spine wall, and a second wall adjacent to the first wall and including an entrance to the work area. The height of the second wall is greater than the height of the first wall, and the height of the first wall is greater than the height of the spine wall.

9 Claims, 39 Drawing Sheets

U.S. PATENT DOCUMENTS 3,058,174 A 10/1962 Sterling
3,125,042 A 3/1964 Mapson
3,292,328 A 12/1966 Lewis et al.
3,360,136 A 12/1967 Ain
3,468,509 A 9/1969 Foltz
3,598,433 A 8/1971 Savickas
3,659,389 A 5/1972 Forberg
3,713,677 A 1/1973 Du Preez
3,788,378 A * 1/1974 Sobel ..... 160/135
3,839,834 A 10/1974 Goddard
3,848,387 A * 11/1974 Hafner ..... 52/213
3,871,435 A * 3/1975 Lopatka ..... 160/135
4,076,126 A 2/1978 Gilmour
4,123,879 A 11/1978 Blodee et al.
4,180,298 A 12/1979 Borgerson, Jr.
4,193,438 A 3/1980 Pastore
4,195,889 A * 4/1980 Coyne ..... 312/240
4,224,769 A * 9/1980 Ball et al. ..... 52/36.1
4,386,870 A 6/1983 Baroody
4,427,244 A 1/1984 Castagna
4,535,577 A * 8/1985 Tenser et al. ..... 174/495
4,561,210 A 12/1985 Kvas et al.
4,619,486 A 10/1986 Hannah et al.
4,628,980 A 12/1986 Le Houillier
4,631,881 A 12/1986 Charman
4,691,885 A * 9/1987 Lawrance ..... 248/165
4,742,645 A 5/1988 Johnston
4,821,477 A * 4/1989 Rydqvist ..... 52/239
4,876,835 A * 10/1989 Kelley et al. ..... 52/239
4,915,535 A 4/1990 Willetts
4,921,370 A 5/1990 Handler et al.
5,058,347 A 10/1991 Scheulke
5,062,535 A 11/1991 Potter
5,083,512 A * 1/1992 Newhouse et al. ..... 108/50.02
5,102,253 A * 4/1992 Pugliesi-Conti et al. ..... 403/5
5,125,202 A 6/1992 Kissinger
5,282,341 A * 2/1994 Baloga et al. ..... 52/32
5,309,686 A 5/1994 Underwood et al.
5,332,021 A 7/1994 Todd et al.
5,373,793 A * 12/1994 Crossman ..... 108/42
5,377,466 A 1/1995 Insalaco et al.
5,392,934 A 2/1995 Fox
5,394,658 A * 3/1995 Schreiner et al. ..... 52/36.1
5,487,246 A 1/1996 Hodges
5,511,348 A 4/1996 Cornell et al.
5,592,886 A 1/1997 Williams et al.
5,598,790 A 2/1997 Fich
5,606,836 A 3/1997 Insalaco et al.
5,624,166 A 4/1997 Theken et al.
5,651,219 A 7/1997 Baloga et al.
5,680,942 A 10/1997 McAllister et al.
5,694,729 A 12/1997 Blackburn et al.
5,743,052 A * 4/1998 Mayhall et al. ..... 52/36.1
5,758,466 A 6/1998 Tucker
5,784,843 A 7/1998 Greer et al.
5,806,258 A 9/1998 Miedema et al.
5,816,001 A 10/1998 Goodman
5,867,955 A 2/1999 Russell
5,873,205 A 2/1999 Hanlon et al.
5,875,597 A 3/1999 Gingrich et al.
5,908,002 A 6/1999 Alexander et al.
5,918,422 A * 7/1999 Bucher, Jr. ..... 52/36.5
5,947,034 A 9/1999 Belka et al.
5,950,371 A 9/1999 Rives et al.
5,961,246 A 10/1999 Mitsubori
5,966,879 A 10/1999 Verbeek et al.
5,992,332 A * 11/1999 Grabowski ..... 108/64
6,009,676 A 1/2000 Feldpausch et al.
6,062,149 A 5/2000 Duvivier et al.
6,067,762 A * 5/2000 Greer et al. ..... 52/220.7
6,095,226 A * 8/2000 Chen et al. ..... 160/135
6,098,358 A 8/2000 Waalkes et al.
6,115,977 A 9/2000 Hornberger et al.
6,134,845 A 10/2000 Shipman et al.
6,141,926 A 11/2000 Rossiter et al.
6,148,567 A 11/2000 DeRuiter et al.
6,161,486 A * 12/2000 Boots ..... 108/48
6,170,211 B1 1/2001 Boyce
6,173,543 B1 1/2001 Gortsema et al.
6,173,545 B1 1/2001 Feldpausch et al.
6,209,273 B1 4/2001 Jeffers et al.
6,227,752 B1 5/2001 Friedrich
6,230,459 B1 5/2001 Jeffers et al.
6,250,032 B1 6/2001 Davis et al.
6,261,026 B1 7/2001 Conley et al.
6,272,803 B1 8/2001 Stachowiak et al.
6,301,846 B1 10/2001 Waalkes et al.
6,330,773 B1 12/2001 MacDonald et al.
6,345,478 B1 2/2002 Pang
6,351,917 B1 3/2002 MacDonald et al.
6,378,255 B1 * 4/2002 Eich et al. ..... 52/220.7
6,415,553 B1 7/2002 Krayer, Jr. et al.
6,450,107 B1 9/2002 Sanz Novales
6,471,309 B1 10/2002 Turner
6,481,168 B1 11/2002 Hodges
6,490,829 B1 12/2002 Schreiner et al.
6,565,279 B1 5/2003 Skovronski et al.
6,663,267 B2 12/2003 Newhouse et al.
6,684,583 B2 2/2004 Hodges
6,701,682 B2 3/2004 Ando et al.
6,735,908 B2 * 5/2004 Edwards ..... 52/36.1
6,955,204 B1 * 10/2005 Gilbert et al. ..... 160/135
6,964,138 B2 * 11/2005 Carroll et al. ..... 52/239
6,997,115 B2 * 2/2006 Lockwood et al. ..... 108/115
2002/0092628 A1 7/2002 Todd
2002/0112654 A1 * 8/2002 Cattaneo ..... 108/155
2003/0154673 A1 8/2003 MacGregor et al.
2003/0172592 A1 9/2003 Krimmel
2003/0182884 A1 10/2003 Kishimoto et al.

FOREIGN PATENT DOCUMENTS

DE 2502765 A1 7/1976
DE 32 35 758 A1 3/1984
DE 44 37 337 11/1995
DE 19914319 A 3/1999
EP 0311304 A2 9/1988
EP 0527658 A1 8/1992
EP 0536979 A 10/1992
EP 0551186 A1 1/1993
EP 0476399 7/1995
GB 0789460 A 1/1958
GB 2326429 2/1998
JP 1027795 1/1998
JP 10216444 7/1998
JP 11-206469 8/1999
JP 2000-023754 1/2000
WO WO 92/09776 A1 6/1992

OTHER PUBLICATIONS

"Feng Shui Office—10 Golden Rules for Employees", Alexa Lee, [Retrieved Mar. 4, 2008] retrieved from the Internet: URL: http://ezinearticles.com/?feng-Shui-Office—10-Golden-Rules-for-Emplyees&id=631370, pp. 1-3—see p. 2, Rule 5.
Examination Report, GB 0524881.0, dated Jan. 14, 2008, 5 pages.
The illustration '*3dplan*', retrieved from the Internet on Nov. 10, 2008 at http://www.theofficefurniturestore.net/photos/3dplan.jpg, p. 1 of 1. (Believed to be published prior to May 28, 2004).
Examination Report from the Canadian Intellectual Property Office, dated Nov. 5, 2008 (3 pages).
Examination Report in Canadian Application No. 2,625,474, dated Dec. 16, 2008, two (2) pages.

* cited by examiner

Figure 4A
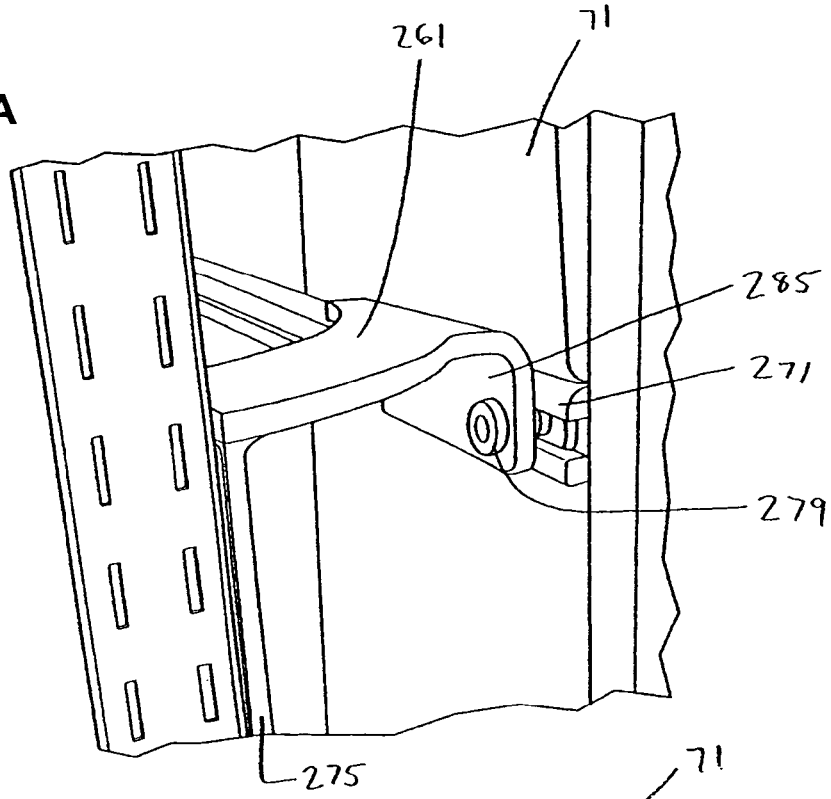
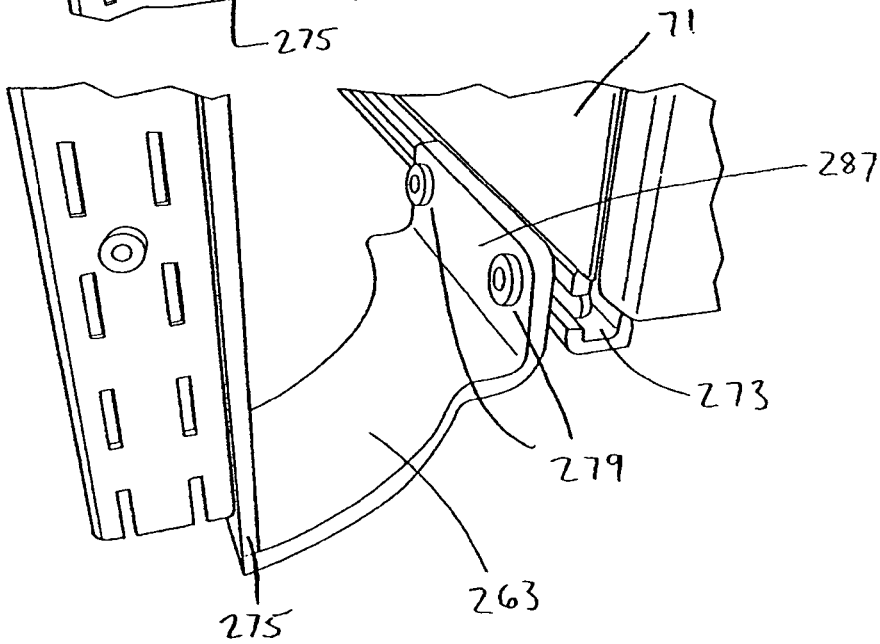
Figure 4B

Figure 6
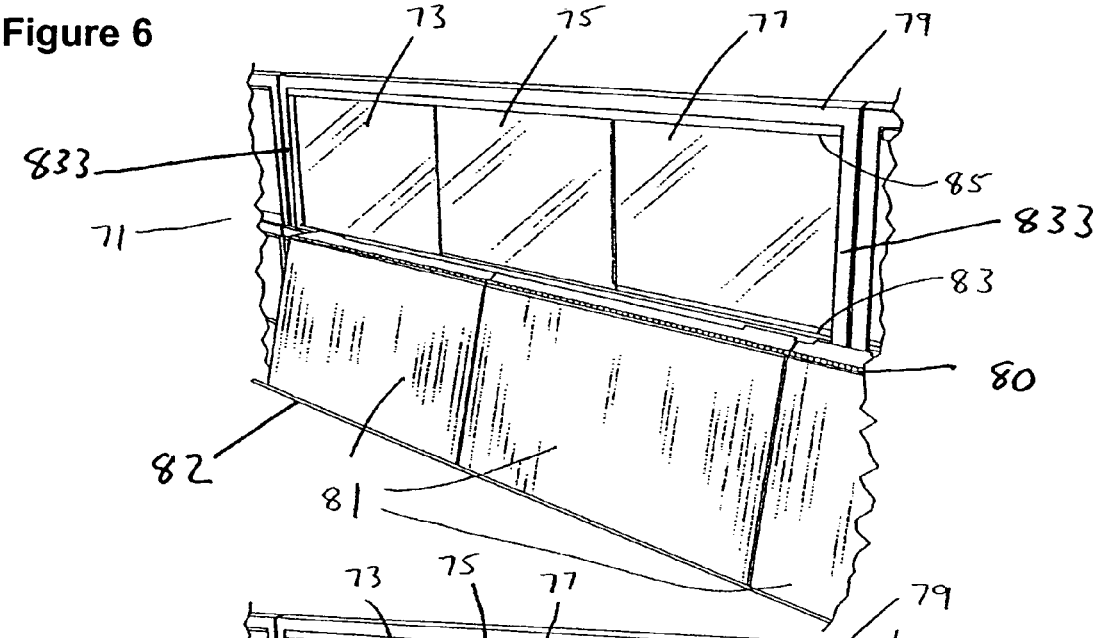
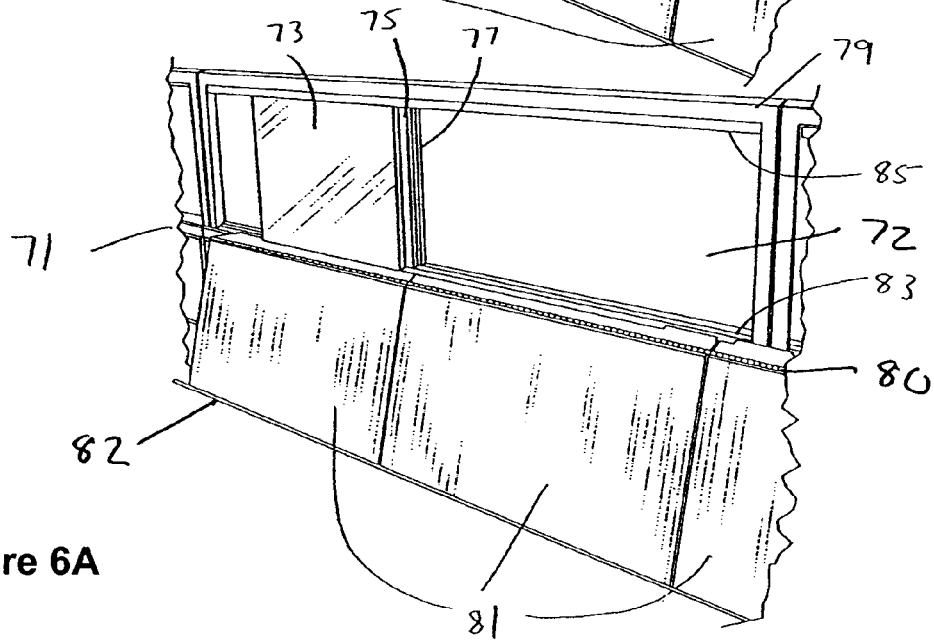
Figure 6A

Figure 9
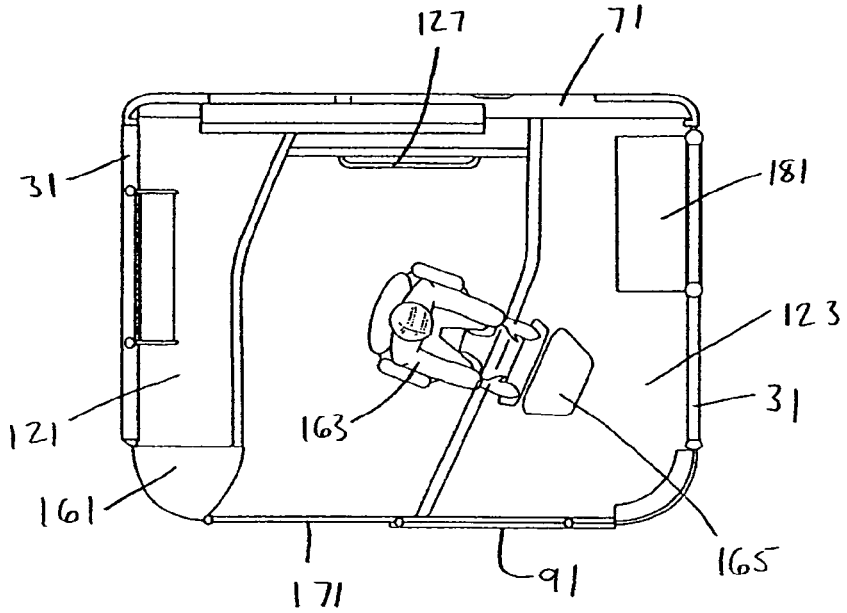
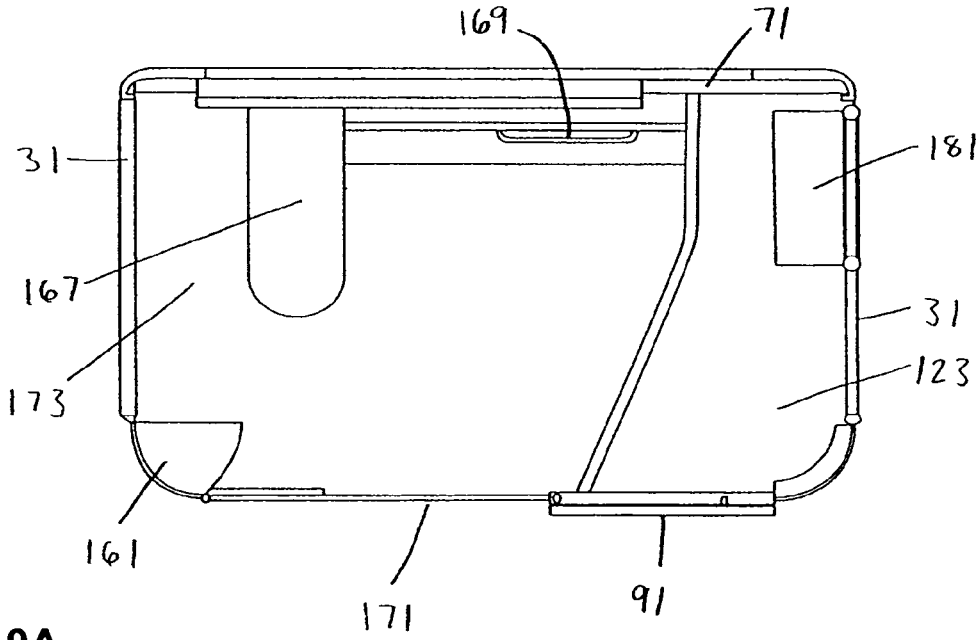
Figure 9A

Figure 13A
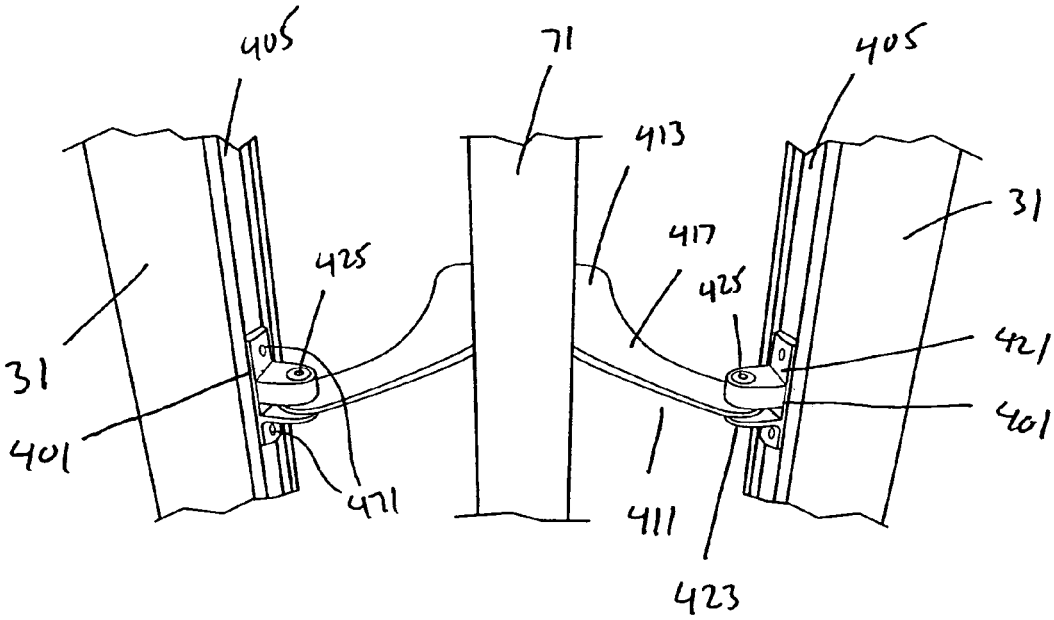
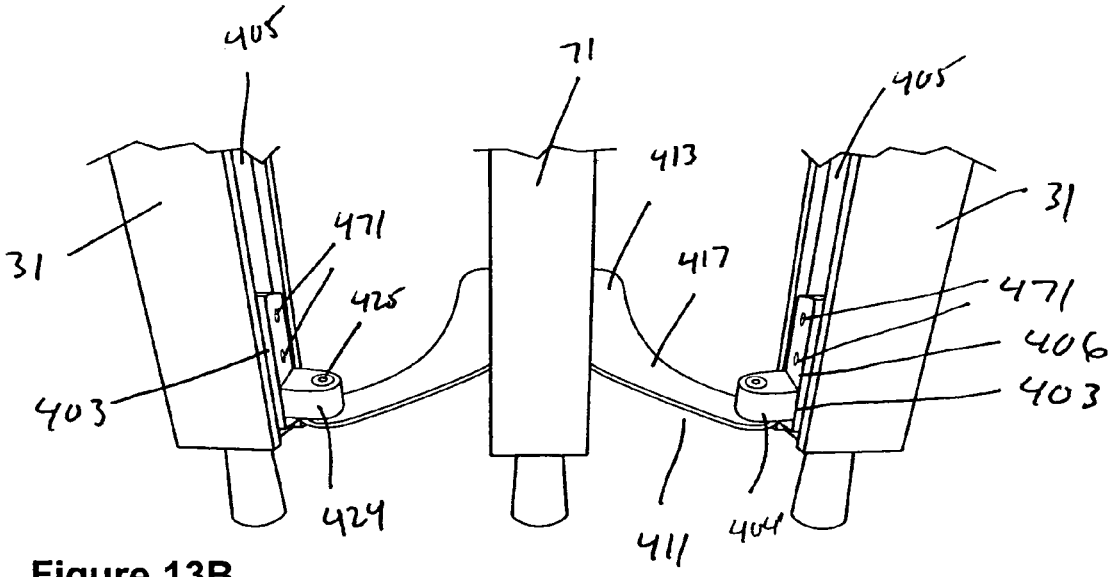
Figure 13B

Figure 14B
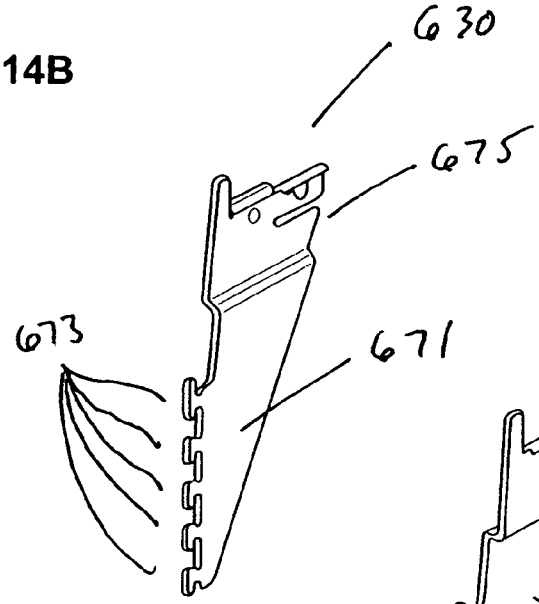
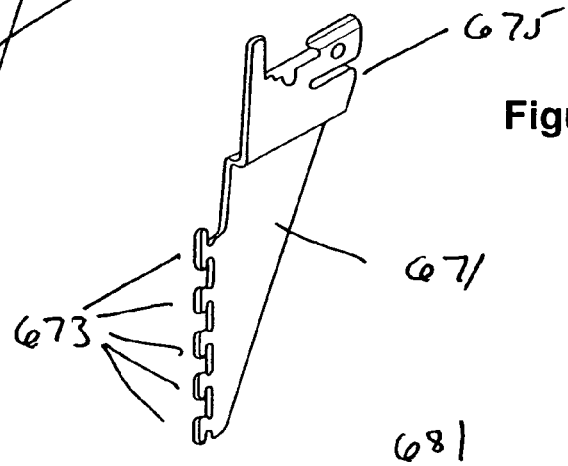
Figure 14C
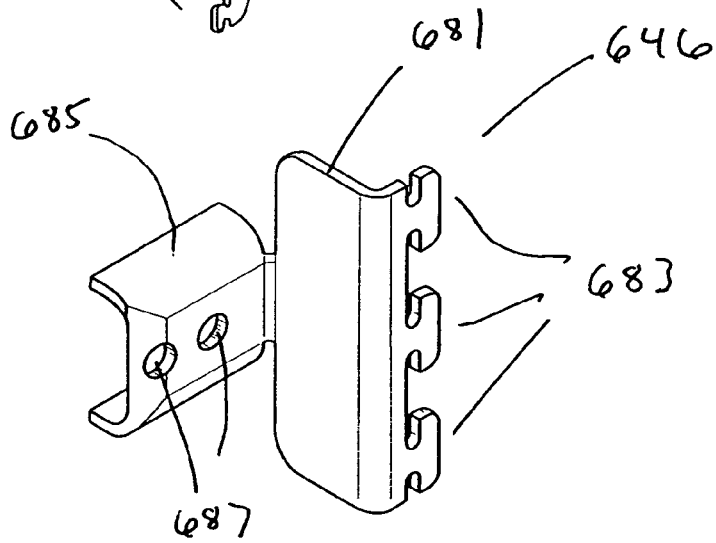
Figure 14D

Figure 18C
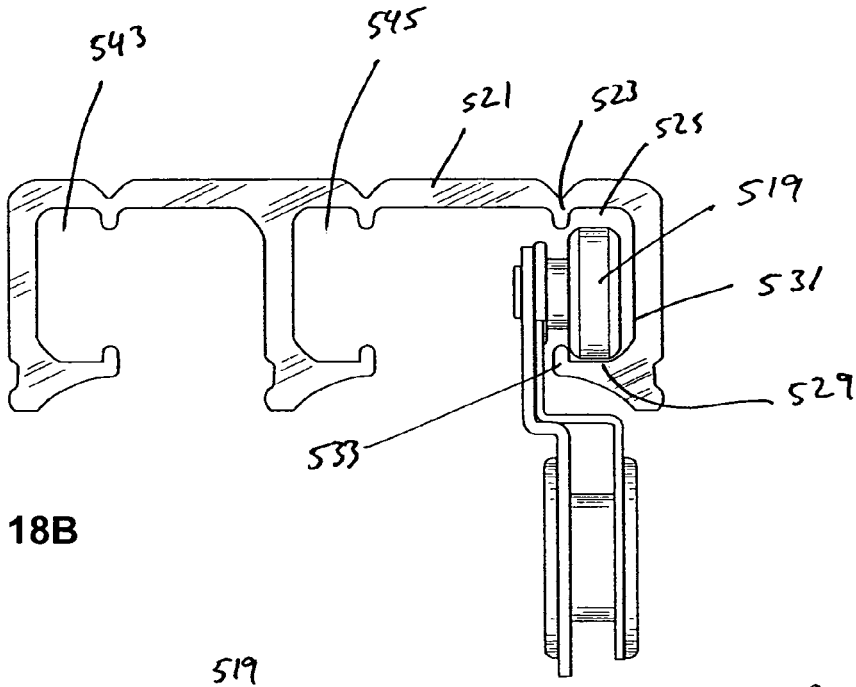
Figure 18B
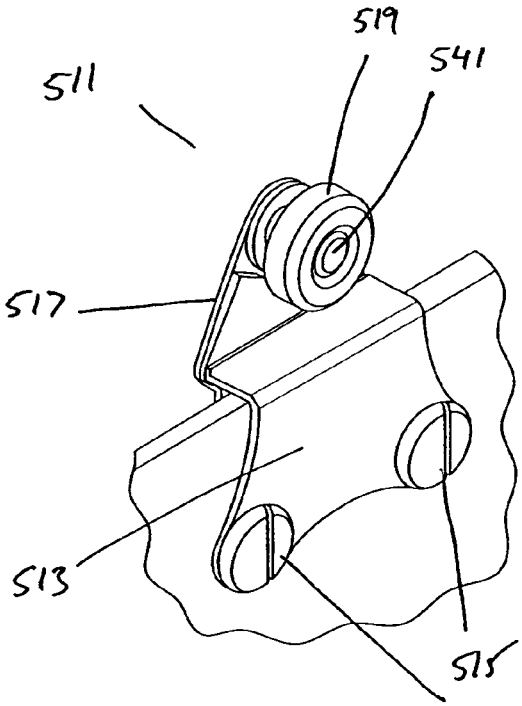
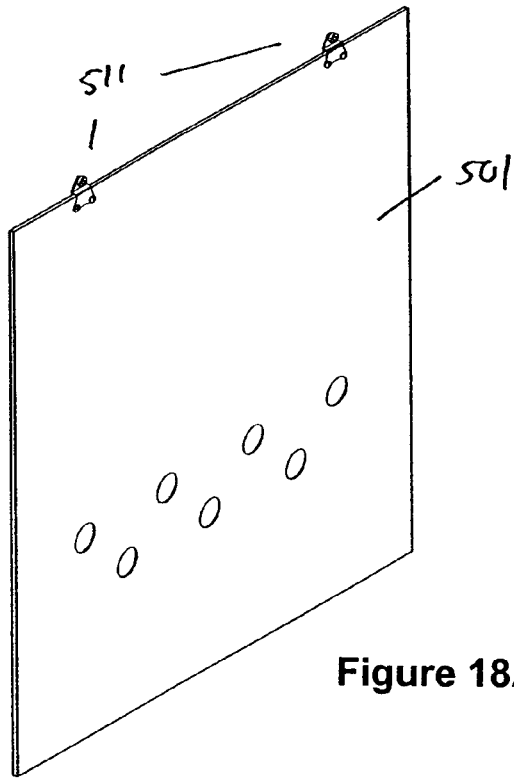
Figure 18A

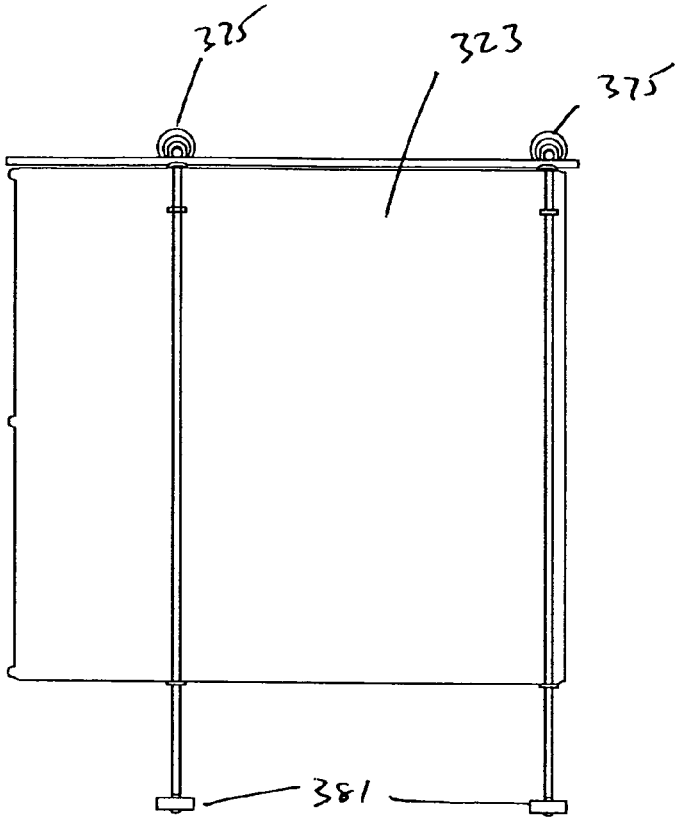
Figure 19E
Figure 19G
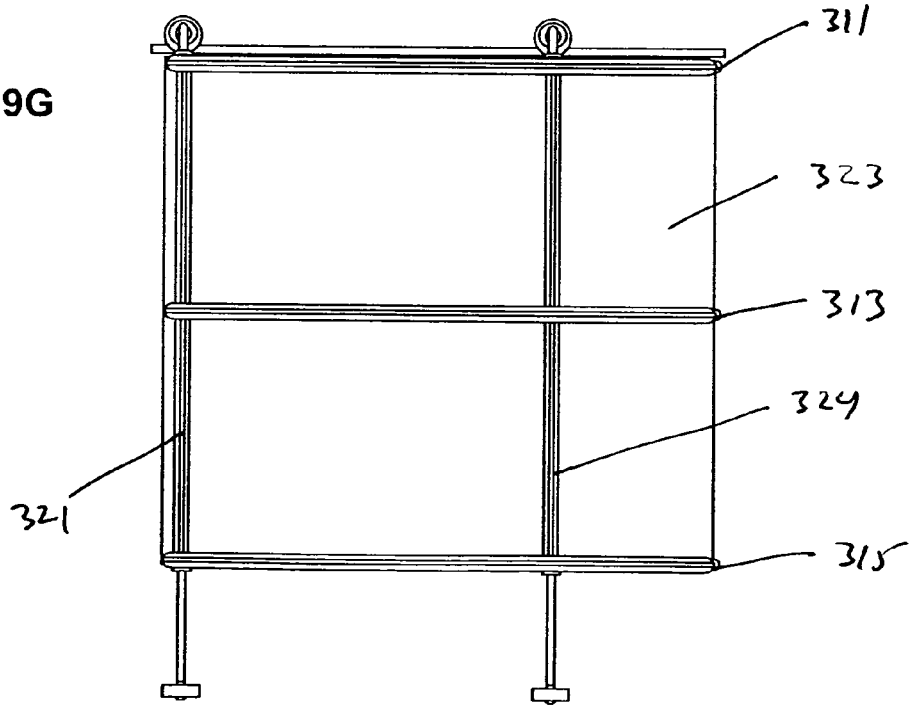

WORK SPACE MANAGEMENT SYSTEM

RELATED APPLICATION

This application claims the benefit under 35 U.S.C. § 119 (e) of U.S. Provisional Patent Application No. 60/475,061, filed May 30, 2003, the entire disclosure of which is hereby incorporated herein by reference.

BACKGROUND OF THE INVENTION

The present invention relates to a system for arranging work spaces within an office. In particular, the invention relates to a work space system with work surfaces and panel arrangements which allows greater privacy, greater user control over accessibility, and improved worker orientation.

Although systems work spaces have become the common work area in much of the corporate world, most people would still prefer a private office with a door over a systems work space. Indeed, the private office has much to offer. Such a work space gives security, privacy, and a sense of control and ownership. However, there is a disadvantage to the private office. It can isolate people, hinder free and spontaneous communication, take up expensive real estate, and tend to signal a privileged position in the corporate hierarchy. For many organizations, private offices for everyone—even if everyone wanted them—simply are not possible. They are too expensive, too difficult to change, and too complicated to manage. Thus, businesses have increasingly turned to systems offices.

A source of dissatisfaction with systems work spaces is their decreasing size. Due to the decrease in space available for office space, work spaces have become smaller. A smaller work space presents challenges to making the work space functional and efficient. There is nothing intrinsically uncivil about small spaces. Yet as systems furniture offices have gotten smaller and smaller, many have become increasingly dysfunctional for a variety of workers, failing to account for changes in the work people do and the way people work.

The challenge is not merely in dealing with smaller work areas. There are several other areas in which traditional office systems designs are deficient. The first is a lack of privacy. Traditional office systems have no door and low walls. The low walls, prevent a sense of privacy and expose the worker to unwanted distractions. Additionally, the user has no control over his interaction with the outside world; he has no way to block outside distractions or, conversely, to communicate to others that he is open to interaction. Additionally, the worker is unable to easily communicate with a fellow worker in an adjacent work space with whom he may be collaborating. Finally, traditional work space designs orient the worker in an awkward position. Standard work surface designs generally have an L-shaped work surface positioned adjacent to the wall opposite the entrance and one of the side walls. Thus, a worker is generally facing away from the entrance to the work space, so that if someone approaches the work space to communicate, the worker has to turn around. All of these problems create an inefficient and uncomfortable work space.

Therefore, there is a need for a systems work space with greater privacy, greater user control over accessibility, and improved worker orientation.

BRIEF SUMMARY

The present invention is directed to a work space system. Various embodiments of the work space system include work surfaces and panel arrangements which allow greater privacy, greater user control over accessibility, and improved worker orientation.

According to one aspect of the invention, a work space system including a plurality of work areas is provided. A work area includes a spine wall, a first wall adjacent to the spine wall and extending from the spine wall, and a second wall adjacent to the first wall and including an entrance to the work area. The height of the second wall is greater than the height of the first wall, and the height of the first wall is greater than the height of the spine wall.

According to another aspect of the invention, a work space system includes a work area, an entrance to the work area, and a first and second work surface. The first work surface is positioned at a first end of the work area. The first work surface includes an edge facing the work area. The edge includes a substantially straight portion. The second work surface is positioned at a second end of the work area opposite the first work surface. The second work surface includes an edge facing the work area. The edge includes a first portion and a second portion meeting at an obtuse angle to form a generally concave edge. A user facing one of the first and second portions of the second work surface will be oriented towards the entrance of the work area.

According to another aspect of the invention, a work space system including a plurality of work areas is provided. A work area includes a spine wall including a spine wall edge. A first wall includes a first wall edge. The first wall is adjacent to the spine wall and extends out from the spine wall. The first wall is offset from the spine wall such that there is an open space between the first wall edge and the spine wall edge.

According to another aspect of the invention, a work surface support includes a plurality of components. The components include a longitudinally extending portion, a laterally extending portion, a vertically extending portion, and at least one connector for connecting to a wall. At least one of the plurality of components is connected to another of the plurality of components by at least one snap fit connection.

According to another aspect of the invention, a wall for a work area in a work space system includes an openable area and at least one panel capable of covering the openable area. The wall is disposed between a first work area and a second work area. The openable area permits visual and audio communication between a user in the first work area and a user in the second work area.

The present invention, together with attendant objects and advantages, will best be understood with reference to the detailed description below in connection with the attached drawings.

BRIEF DESCRIPTION OF THE DRAWINGS

FIG. 4A is an enlarged view of a top wall connector flange.

FIG. 4B is an enlarged view of a bottom wall connector flange.

FIG. 6 shows easel members and panels in a spine wall.

FIG. 6A shows panels in a spine wall in an alternative configuration.

FIG. 9 is a top view of a work area.

FIG. 9A is a top view of an alternative work area.

FIG. 13A is an enlarged view of top connectors.

FIG. 13B is an enlarged view of bottom connectors.

FIG. 14B shows a first view of a work surface support bracket.

FIG. 14C shows a second view of a work surface support bracket.

FIG. 14D shows another work surface support bracket.

FIG. 18A shows a panel for a wing wall.

FIG. 18B shows a roller assembly of a wing wall panel.

FIG. 18C is a cross sectional view of a roller assembly of a wing wall panel disposed in a track assembly.

FIG. 19E shows a rear view of a cabinet assembly.

FIG. 19G shows a front view of a cabinet assembly.

DETAILED DESCRIPTION OF THE PREFERRED EMBODIMENTS

Figure 1:
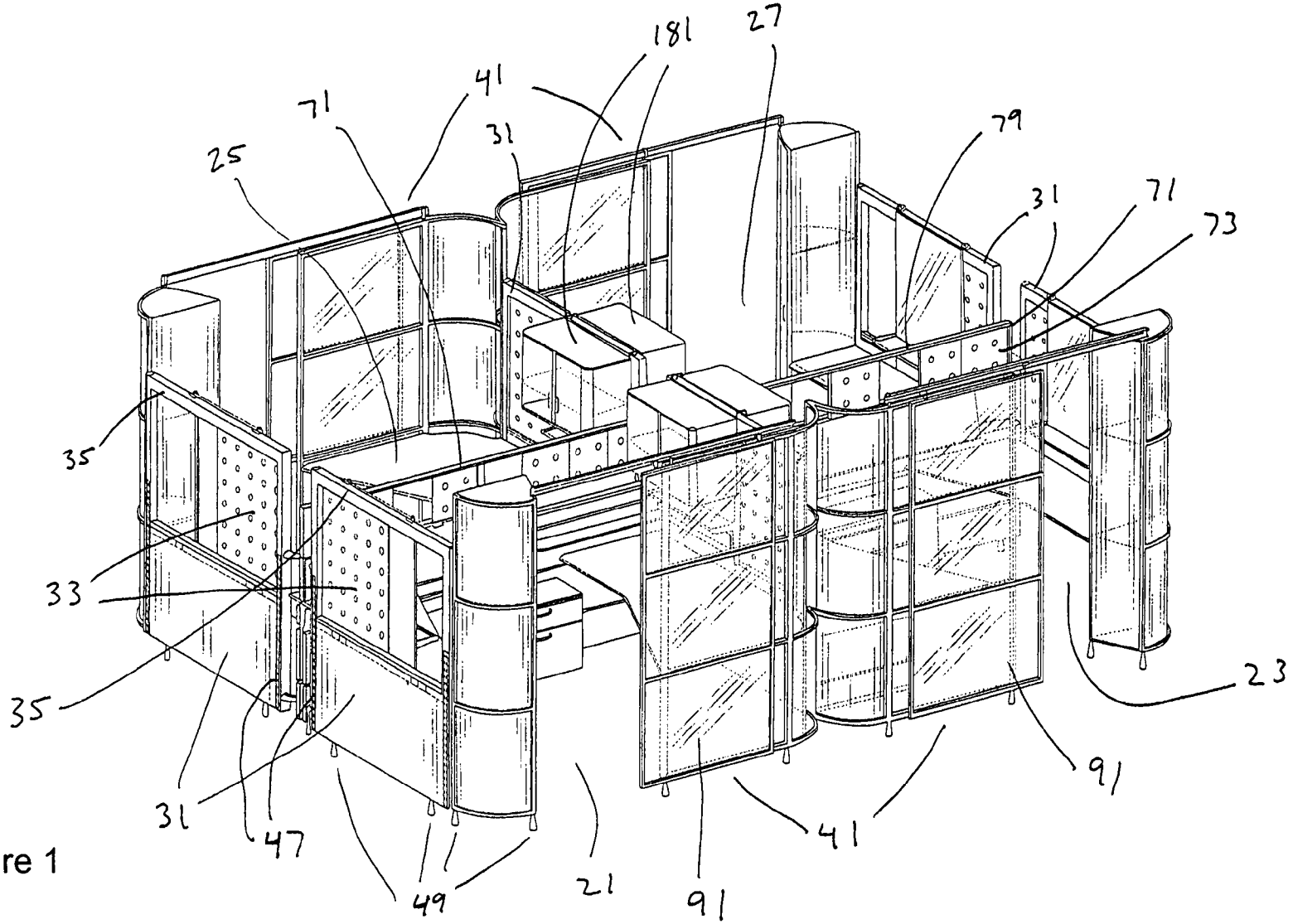
FIG. 1 is a perspective view of embodiments of four work areas.

The invention is described with reference to the drawings. The relationship and functioning of the various elements of this invention are better understood by the following detailed description. However, the embodiments of this invention as described below are by way of example only, and the invention is not limited to the embodiments illustrated in the drawings.

An overall view of an embodiment of the present invention is shown in FIG. 1. The system includes a spine wall 71 which is common to work areas 21, 23, 25, and 27. Side walls, or wing walls, 31 extend out from the spine wall 71. Other walls, or street side walls, 41 are adjacent to the walkway between work areas and are on the opposite side of the work area from the spine wall. The wing walls 31, street side walls 41, and spine walls 71 are supported by feet 49. Positioned in the street side wall 41 is a door 91. Although the embodiment in FIG. 1 shows four work areas, the scope of the invention contemplates any number of work areas. To accommodate more work areas, the spine wall may be extended and more wing walls attached to the spine wall. Other features in a given work area include a rolling cabinet 181, movable panels 33 and 73 in spine walls and wing walls, hanger member 47, electrical outlets 65, and work surfaces. These features will be described in detail below.

In one embodiment, street side wall 41 is the highest of the three walls. This allows the worker a sense of privacy and minimizes distractions from passersby. The presence of a door 91 also allows the user to control the level of privacy and access to the work area. The street side walls 41 and the door 91 may be constructed of a translucent material so that the user can have some indication of outside activity without there being complete visibility. The wing wall 31 is of a lower height than the street side wall 41, and the spine wall 71 is of a lower height than the wing wall 31. The work area has two work surfaces, one adjacent to each wing wall. The arrangement of the wing wall higher than the spine wall gives the worker more privacy in the walls adjacent to the work surfaces. In one embodiment, the spine wall is between about three and about five feet high, the wing wall is between about five and about seven feet high, and the street side wall is between about six and about eight feet high. In another embodiment, the spine wall is about 45" high, the wing wall is about 68" high, and the street side wall is about 78" high.

Turning now to the structure of the walls, in one embodiment both the wing wall 31 and the spine wall 71 have frames 35, 79 positioned at the top of the wall. The frames 35, 79 provide an openable area in the wall. The frames 35, 79 hold panels 33, 73 which are adapted to slide horizontally in the frames and covering the openable area. The openable area permits visual and audio communication between users in adjacent work areas.

The panels 33, 73 may be solid or may have openings in them, such as a pattern of holes. The user may adjust the positioning of the panels in the openable area to control the level of access to users in adjacent work areas. For example, if the user wants privacy, he can position the panels so that the frame is completely closed. If the user desires a small degree of interaction with the adjacent work area, he can position the panels so only the pattern openings are exposed. The user might do this if he wanted to be able to overhear what was going on in an adjacent work area, but he was not fully participating in the conversation. If a user wants maximum openness, he can move all the panels to one end of the frame, allowing complete visual and audio interaction with a user in the adjacent work area.

Figure 2A:
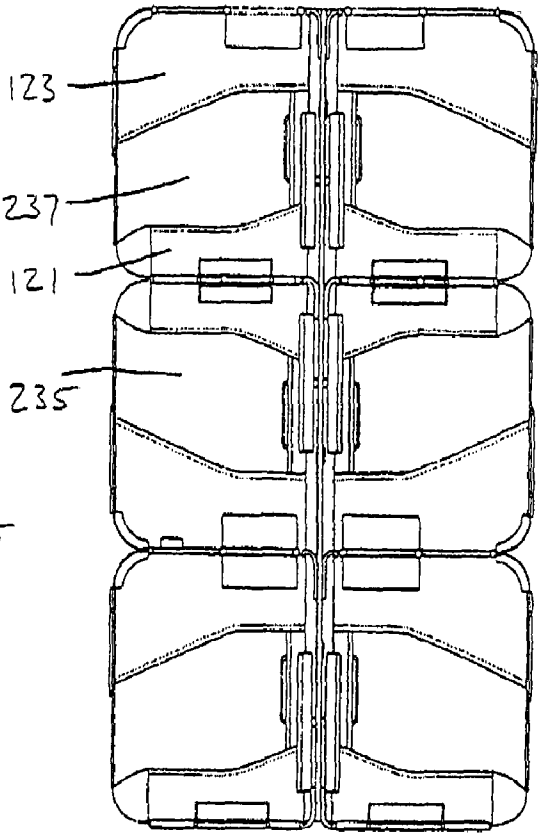
FIG. 2A is top view of another six work areas.
Figure 2:
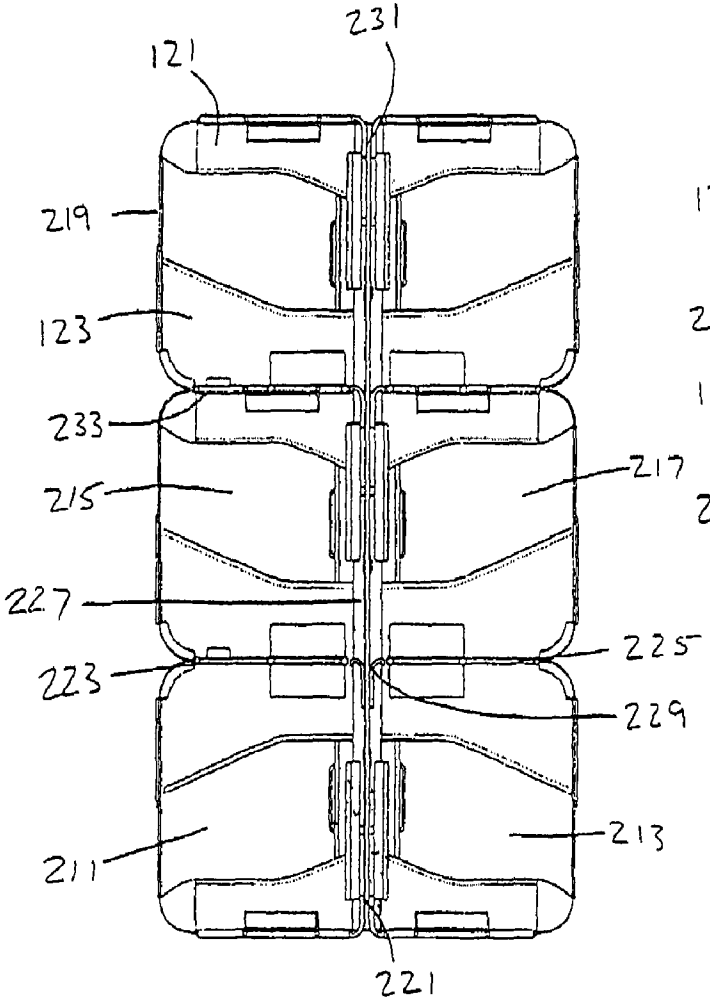
FIG. 2 is a top view of embodiments of six work areas.

The user can also independently control which adjacent work space he wants to interact with. Thus, users collaborating on the same project would be positioned in adjacent work areas. FIGS. 2 and 2A are top views of embodiments of work space layouts for six work spaces. Two basic work surface designs are shown, a smaller work surface 121 and a larger work surface 123. Each work area may have a smaller work surface 121 adjacent to one wing wall, and a larger work surface 123 adjacent to the opposite wing wall. Although FIGS. 2 and 2A show regular patterns to the work surface, the scope of the present invention includes any possible layout of the work surfaces. Turning to FIG. 2, if two users in work spaces 211, 213 adjacent to the same wing wall 221 desired to interact, they could open the panels on spine wall 221. Likewise, if two users in work spaces 211, 215 adjacent to the same section of the wing wall 223 desired to interact, they could open the panels on that section of the wall 223. Additionally, all four users common to a given corner 229 could open the panels in walls 221, 223, 225, and 227 to allow a meeting without even leaving their work areas, thus increasing convenience and minimizing the need for a conference room.

In one embodiment, the present invention includes an improved work surface design. Standard existing work surface designs for systems offices generally have an L-shaped work surface. In existing designs, one leg of the L is positioned adjacent to a side wall and the other leg is positioned opposite the entrance. Thus, where the work surface adjacent to the wall opposite the entrance runs the entire length of the wall, the side walls cannot be adjusted without major changes in the work surface. FIG. 2 illustrates an embodiment of the work space design. The work space has two work surfaces 121 and 123. Work surface 121 is positioned adjacent to one wing wall, with work surface 123 positioned adjacent to the wing wall on the opposite side of the work area. Work surfaces 121 and 123 do not have the conventional design of a completely straight edge, but instead are of an angled design. The end of work surface 121 is parallel to the wing wall towards the entrance 219, and angles into the work area at the end closest to the spine wall 231. The edge of work surface 123 angles from the end closest to the entrance 219 towards the wing wall 233, and runs parallel to the wing wall 233 at the end closest to the spine wall 231. The individual work surfaces 121 and 123 can be located on either wing wall of a given work area, although it may be advantageous for the work surfaces to be depicted in a regular pattern, as shown in FIGS. 2 and 2A.

Figure 9B:
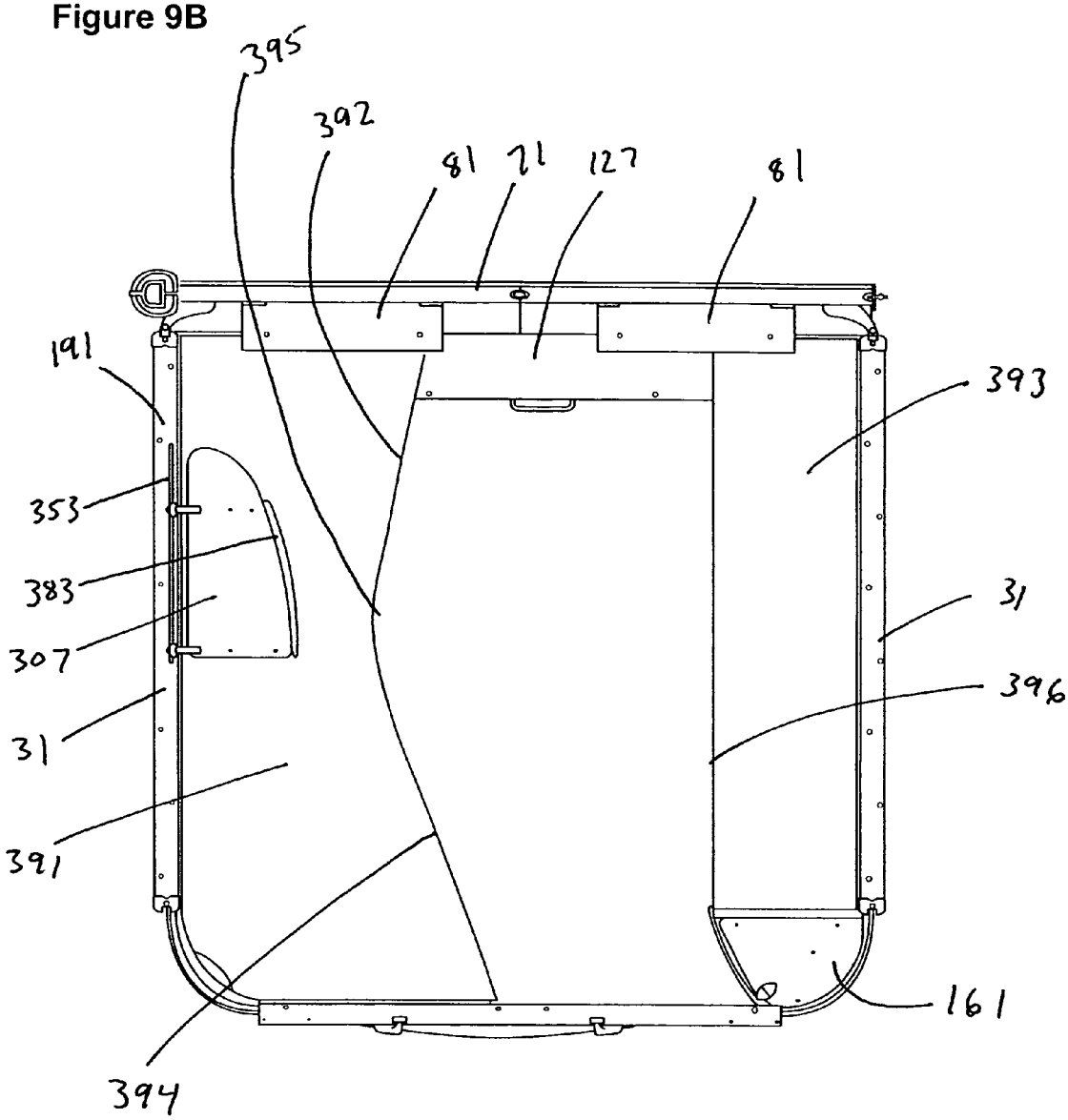
FIG. 9B is a top view of an alternative work area.

Another embodiment of a work surface is shown in FIG. 9B. A first work surface 391 is positioned at one end of the work area, adjacent to a wing wall 31. Another work surface 393 is positioned at the opposite end of the work area, adjacent the other wing wall 31. The edge of work surface 391 facing the work area has a first portion 393 and a second portion 394 meeting at an obtuse angle to form a generally concave edge 395. Work surface 393 has a substantially straight edge 396.

The embodiments of the work surface design shown in FIGS. 2, 2A, and 9B have several features. First, the user is oriented in a convenient position, in that he never has his back to the door. Because of the angled design of the work surfaces, the user has access to most of the surface area of the work surface. Finally, because the two work surfaces are not connected, the wing walls can be moved closer together or farther apart without requiring removal or replacement of the work surface. For example, if a wing wall needs to be moved slightly to accommodate a change in a work area, it will not substantially disrupt the positioning of the two work surfaces in the two adjacent work areas.

Figure 13:
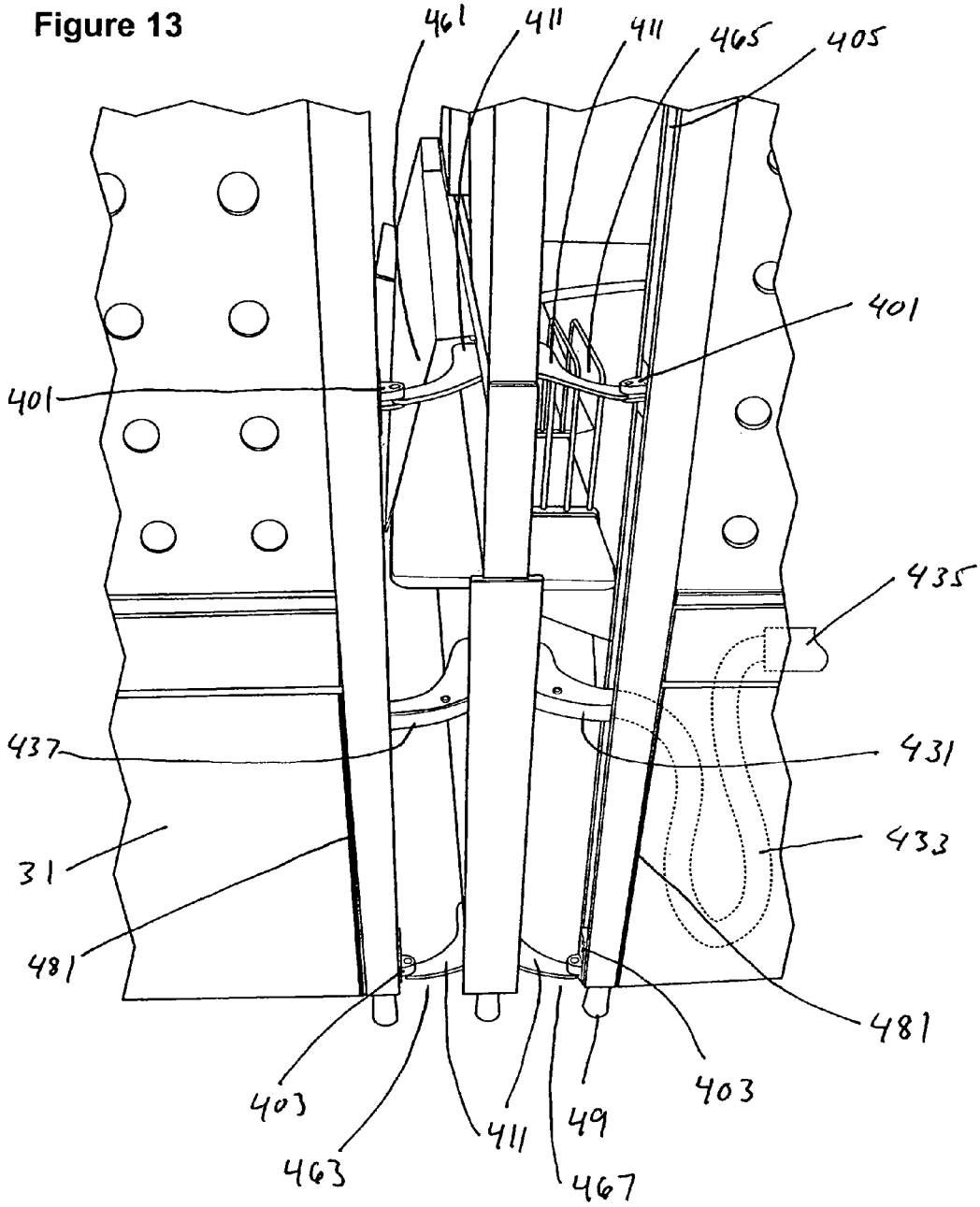
FIG. 13 is a perspective view of wall connectors.
Figure 14:
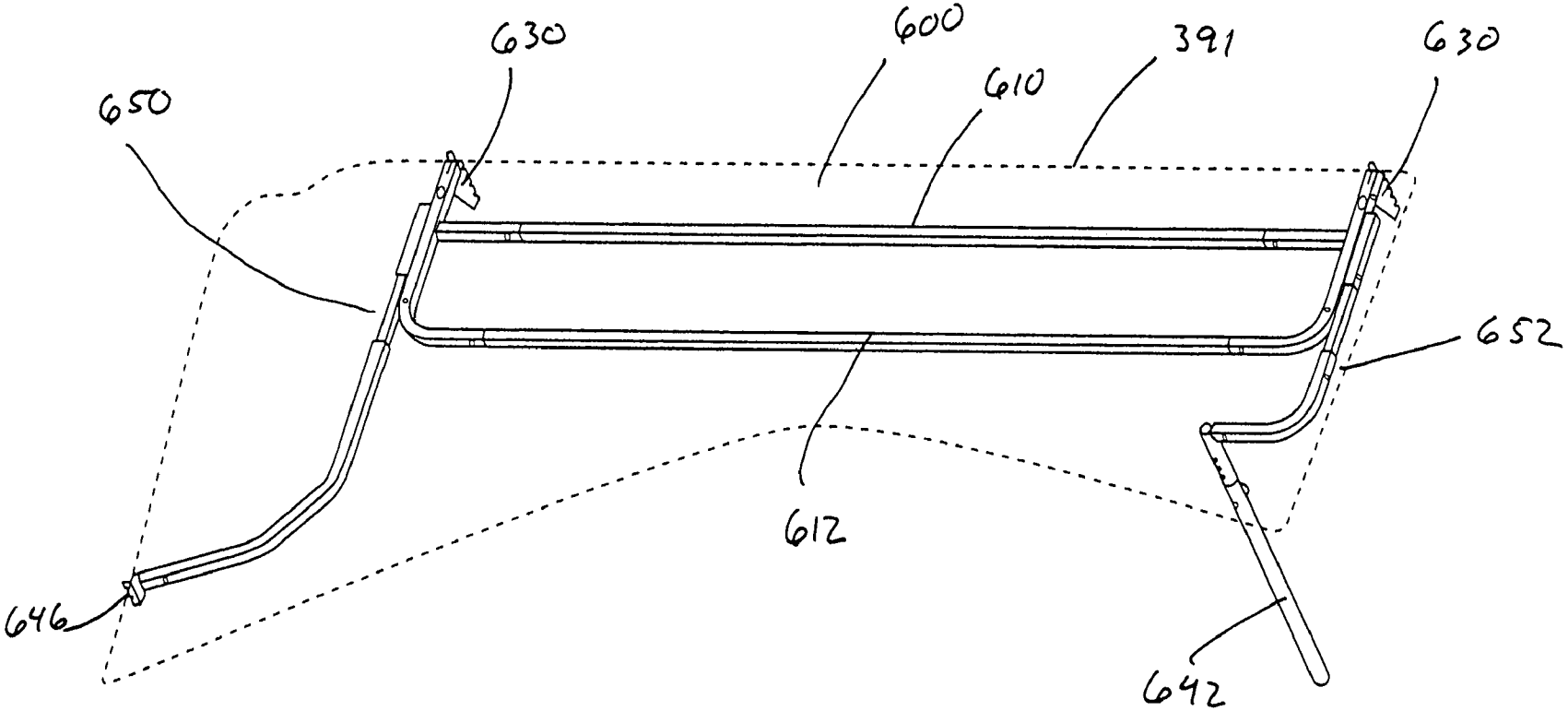
FIG. 14 shows an embodiment of a work surface support.

FIG. 14 shows a support frame 600 for a work surface 391. The general outline of a work surface 391 is shown in dashed lines. The support frame 600 includes a plurality of individual support components. In on embodiment, the frame 600 includes two horizontal beams 610, 612 for supporting the work surface 391. These beams run along the longitudinal direction of the work surface. Two cross supports 650, 652 run the transverse direction of the work surface. The work surface may be secured to one wall by brackets 630 and to another wall by bracket 646. Brackets 630 and 646 include hooks which connect into a pattern of slots in a wall, for example, vertically slotted member 481 in FIG. 13 and vertically slotted member 705 in FIG. 16. The positioning of brackets 630 and 646 in their corresponding slots allows the work surface to be adjusted in height. A vertical support 642 helps to support the weight of the work surface. The vertical support 642 may have an adjustable height mechanism as indicated by holes 643. In one embodiment, vertical support 642 is integrated into a bookcase assembly, as shown in FIG. 14G.

Figure 14A:
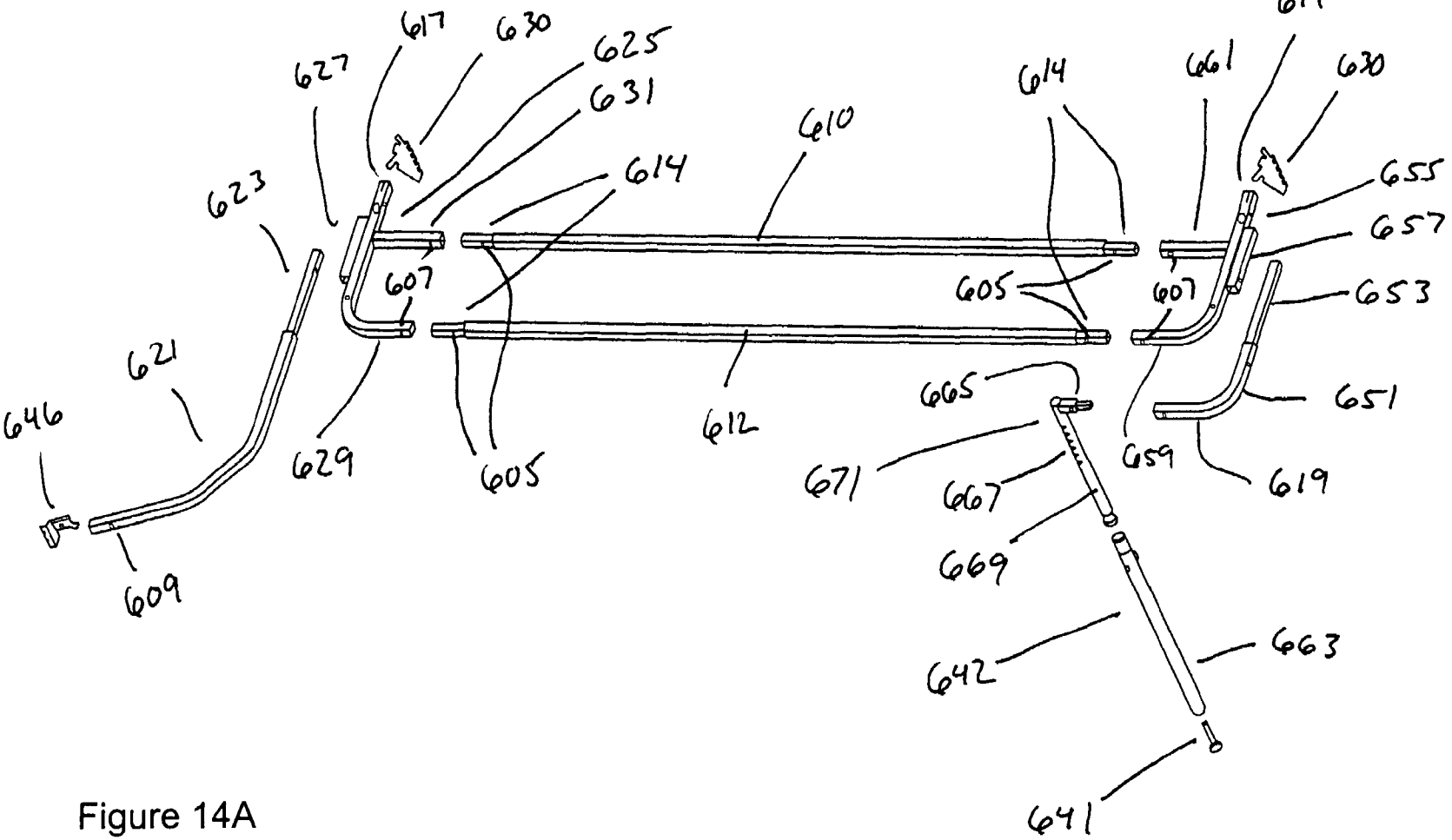
FIG. 14A shows components of a work surface support.

The individual components of support frame 600 are shown in FIG. 14A. The shape of the support frame will depend on the shape of the worksurface, and it is to be understood that other configurations besides those disclosed herein are possible and these variations are intended to be included within the scope of the present invention. In one embodiment, the individual components are connected to each other by mating connections in which the outer surface of the end portion of one part fits within the inner surface of another part. The components may be secured by a snap-fit connection. In one embodiment, the snap-fit connection is a spring button in the inner component and a corresponding hole in the outer component. The components shown in FIGS. 14 and 14A have square cross-sections, but other shapes such as circular are possible and are intended to be encompassed within the scope of the present invention.

As shown in FIG. 14A, the horizontal beams 610 and 612 are attached to end pieces 625, 655. End piece 625 includes side connection members 629, 631 and end connection member 627. Similarly, end piece 655 includes side connection members 659, 661 and end connection member 657. Horizontal beams 610 and 612 each have ends 614 which fit into side connection members 629, 631, 659, 661 in end pieces 625, 655. The outer surface of ends 614 of horizontal beams 610, 612 is slightly smaller than the inner surface of ends 629, 631. In one embodiment, spring buttons 605 in ends 614 snap into holes 607 in ends 629, 631 to secure the components of the support frame together. Similar connections are present in the other components of the support frame. One embodiment of this type of connection is shown in more detail in FIG. 14F. Lateral support member 621 turns outwardly and has a first end 623 which fits within end connection member 627 to secure lateral support member 621 to end piece 625. Lateral support member 621 has a second end 609 which connects to bracket 646. Member 651 has a first end 653 which fits within end member 657 to secure end member 651 to end piece 655. Brackets 630 slide into the hollow interior of end pieces 625, 655. Vertical support 642 includes a main support 663 and a connecting member 671. Foot 641 is disposed in the bottom of main support 663. Connecting member 671 includes a vertical portion 669 which slides into main support 663 and a horizontal connector 665 which attaches to member 661. Button 647 may be inserted into one of holes 667 in order to adjust the height of the worksurface.

FIGS. 14B and 14C show two embodiments of bracket 630. Bracket 630 includes a first portion 675 adapted to fit within the slots 617, 619 in end pieces 625 and 655. Bracket 630 also includes an angled portion 671 and a plurality of hook members 673. Hook members 673 are adapted to fit into slots disposed in a wall, for example, in vertically slotted member 481 in FIG. 13 and vertically slotted member 705 in FIG. 16. FIG. 14D shows an embodiment of bracket 646.

Bracket 646 includes a first portion 685 adapted to attach to the end 609 of lateral support member 661. Holes 687 provide a point of attachment. Bracket 646 also includes a second portion 671 and a plurality of hook members 683. Hook members 673 are adapted to fit into slots disposed in a wall.

Figure 14E:
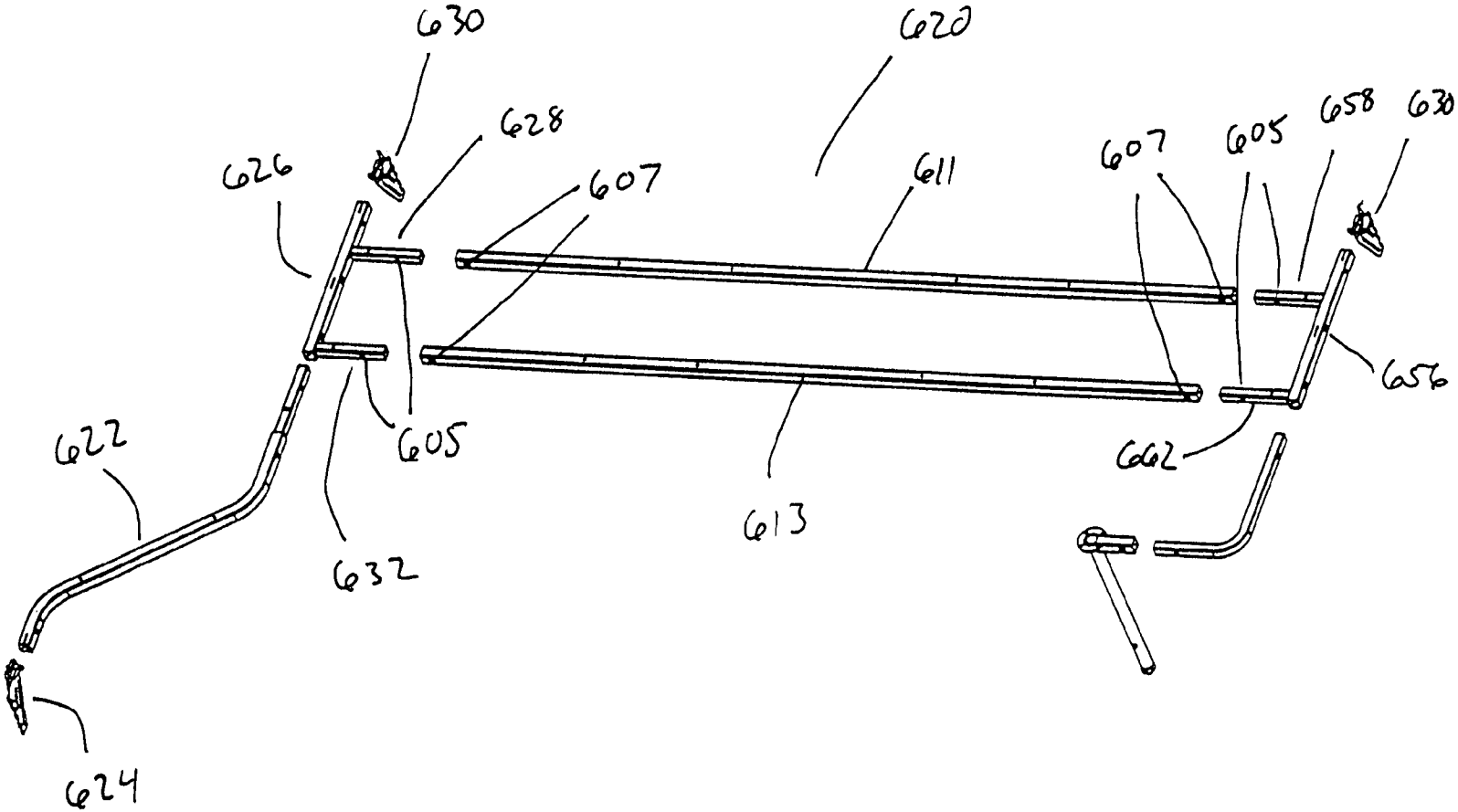
FIG. 14E shows another embodiment of a work surface support.

FIG. 14E shows an alternative embodiment of a work surface support frame 620. The support frame 620 includes a plurality of individual support components. The frame 620 includes two horizontal beams 611, 613 running along the longitudinal direction of the work surface. The support frame may be secured to one wall by brackets 630 and to another wall by bracket 624. Brackets 630 and 624 include hooks which connect into a pattern of slots in the walls, for example, in vertically slotted member 481 in FIG. 13 and vertically slotted member 705 in FIG. 16. The horizontal beams 611 and 613 are attached to end pieces 626, 656. End piece 626 includes side connection members 628, 632. Similarly, end piece 656 includes side connection members 658, 662. The ends of connection members 628, 632 slide into the ends of horizontal members 611, 613. Lateral support member 622 turns outwardly and connects to bracket 624. The individual components of the work surface support frame 620 connect together in a snap fit connection. In one embodiment, the snap fit connection includes a spring button disposed in an inner component and a hole disposed in an outer component.

Figure 14F:
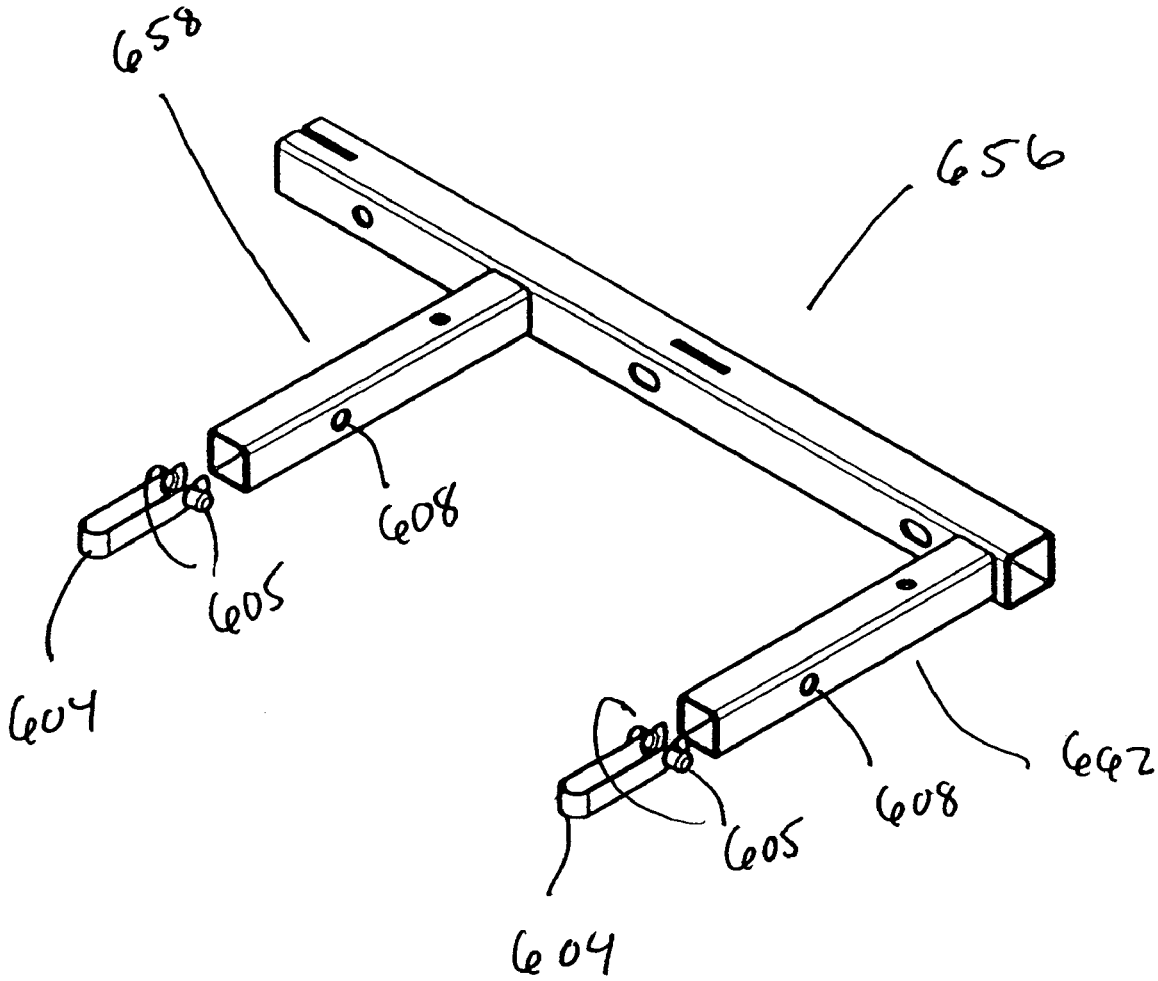
FIG. 14F shows a component of a work surface support.
Figure 14G:
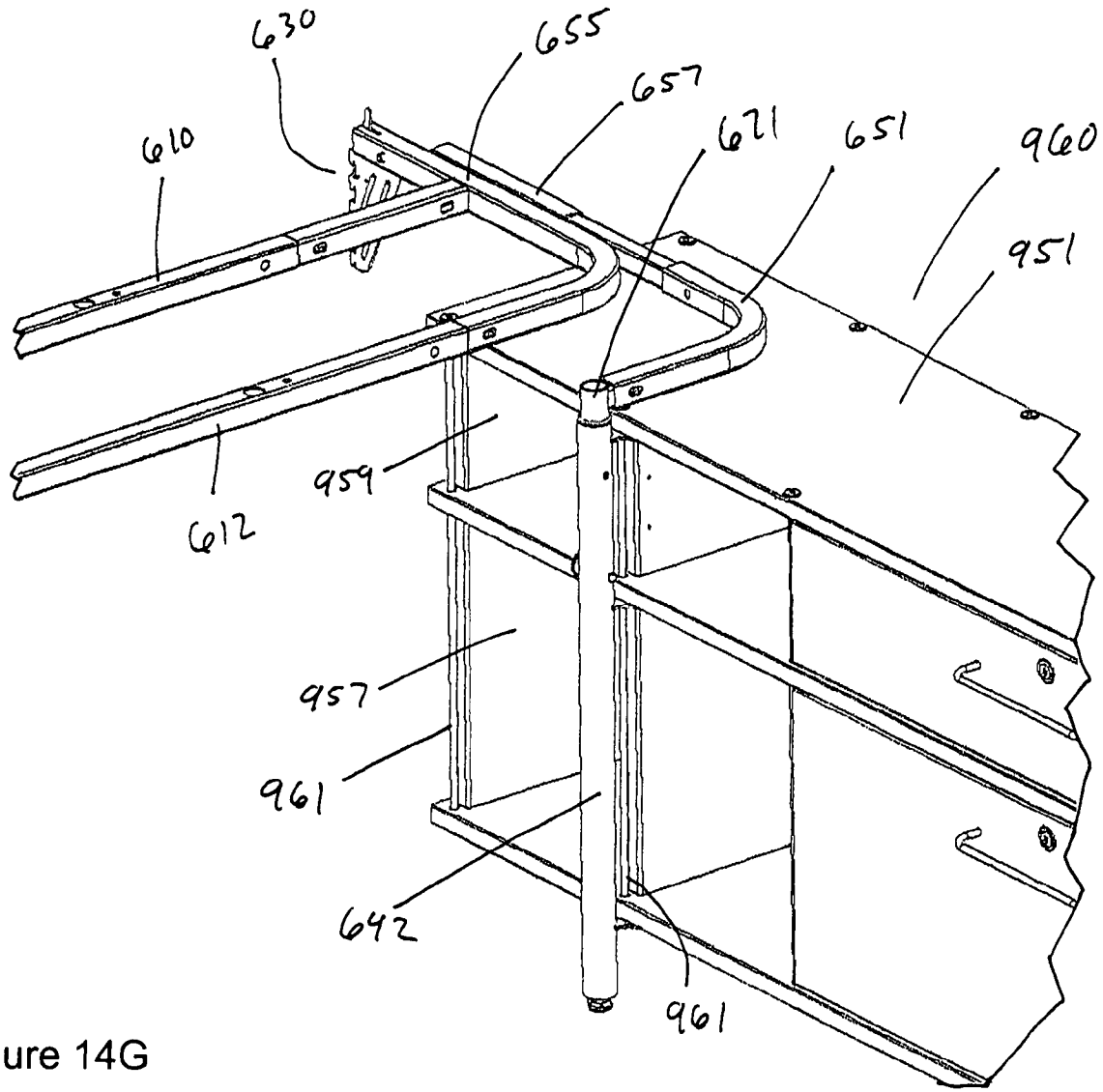
FIG. 14G shows a connection between a work surface support and a bookcase assembly.

FIG. 14F shows end piece 656 with side connection members 658, 662. Side connection members 658, 662 include holes 608. Spring clip 604 includes two buttons 605. Spring clip 604 is biased outwardly so that when inserted into member 658, buttons 605 are disposed in holes 608 and spring clip 604 is secured within member 658. Buttons 605 provide a snap fit connection to connect individual components of the support frame together.

Figure 3:
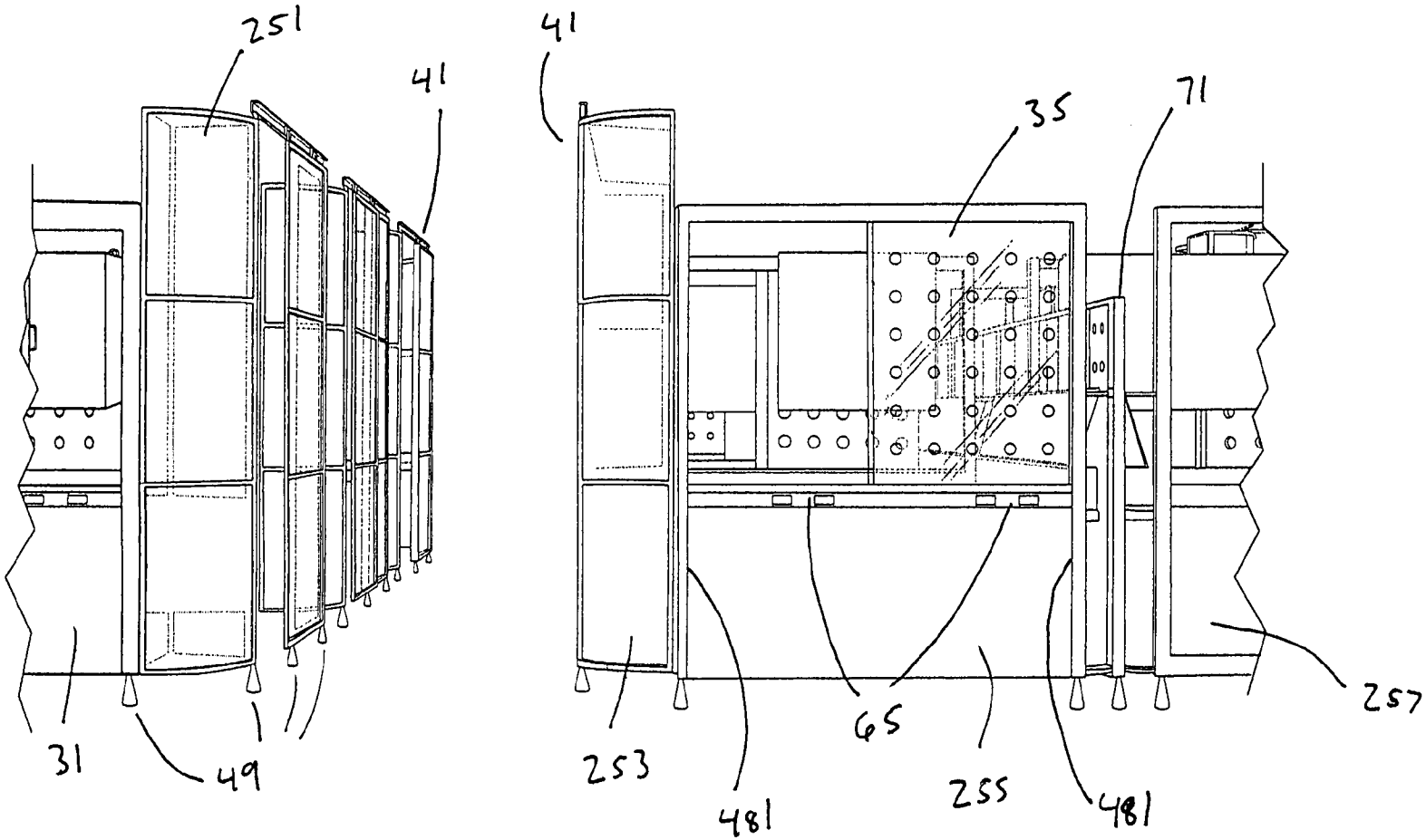
FIG. 3 is a perspective view of a walkway between work areas.

FIG. 3 shows a walkway between work areas. In one embodiment, on each side of the walkway is street side wall 41. At the corners connecting the street side wall 41 with the wing walls 31 are corner pieces 251, 253. A section of the spine wall 71 can be seen between wing walls 255, 257. There is a gap between the spine wall 71 and each wing wall 255, 257. The walls are supported by feet 49. The depicted embodiment shows conical feet, but it is to be understood that the scope of the present invention includes feet of any design or even the absence of feet. At each edge of the wing walls 31 are hanger frames 47. The hanger frame 47 includes two vertical rows of vertical slots which allow for attachment of various items, including the work surfaces and other peripheral devices. In another embodiment, shown in FIG. 13, the vertically slotted member 481 is disposed in the interior of the panel between the frame and the cladding. Electrical outlets 65 are disposed in the wing wall.

Figure 4:
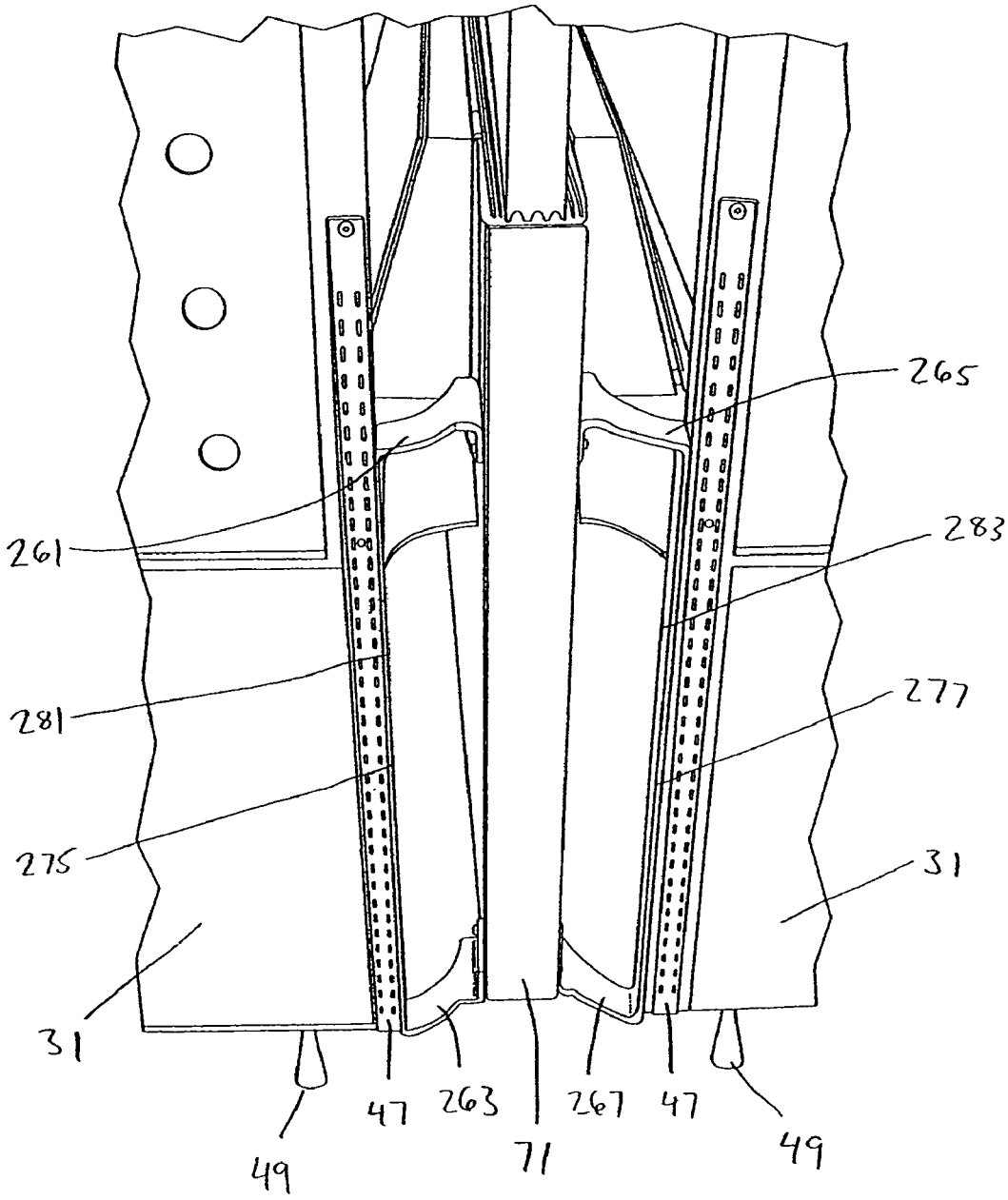
FIG. 4 is a view of embodiments of wall connectors.

In one embodiment, the wing walls 31 are attached to the spine wall 71 such that there is a gap between the spine wall and the wing wall, as illustrated in FIG. 4. The spine wall edge and the first wall edge are between about 2 inches and about 10 inches apart. In one embodiment, a connector 281 is attached to the edge of wing wall 31, adjacent to the hanger frame 47. The connector 281 comprises a vertical portion 275 and two horizontal flanges 261, 263. Attached to the wing wall on the opposite side of the spine wall 71 is a similar connector 283 which comprises a vertical portion 277 and two horizontal flanges 265, 267. FIGS. 4A and 4B show enlarged views of the top and bottom flanges, respectively, of connector 281. The flanges 261, 263 attach to mounting channels 271, 273 in the spine wall 71. The top flange 261 has a lip 285 which attaches to the mounting channel 271 by a fastener 279. In a similar fashion, the bottom flange 263 has a lip 287 which attaches to the mounting channel 273 by means of bolts 279.

The mode of attachment of the flanges 261, 263 to the mounting channels 271, 273 allows the wing wall to be adjusted "off-module," i.e., positioned in any location along the horizontal channel. This mounting arrangement between the wing wall and the spine wall has several other advantages. Because the wing walls can be positioned off-module, there is greater flexibility in positioning the work areas in a given open office area; it can easily be adjusted to accommodate support columns and similar obstacles. Also, the gap between the wing wall and the spine wall allows users in transverse work areas to have some visual contact with each other, even though they do not share a common wall. The position of the wing wall can be easily changed to accommodate changing work space conditions and needs.

Another embodiment of the connector between the wing wall and the spine wall is shown in FIG. 13. Wing wall 31 is connected to spine wall 71 by two connectors, a lower connector 463 and a top connector 461 on the left side and a corresponding lower connector 467 and top connector 465 on the right side. Each of the lower connectors 463, 467 includes a connecting member 411 and a lower mounting member 403. Each of the top connectors 461, 465 includes a connecting member 411 and top mounting member 401.

FIGS. 13A and 13B show enlarged views of embodiments of the top and bottom connectors, respectively. The mounting member 401 includes a base portion 421 and an extending portion 423. The mounting member 403 includes a base portion 406 and an extending portion 404. In one embodiment, the mounting members 401 and 403 are disposed in a channel 405 in the edge of the wing wall 31. Fasteners 471 are disposed through base portion 421 of upper mounting member 401 and base portion 406 of lower mounting member 401 to attach the mounting members to the spine wall.

Figure 13C:
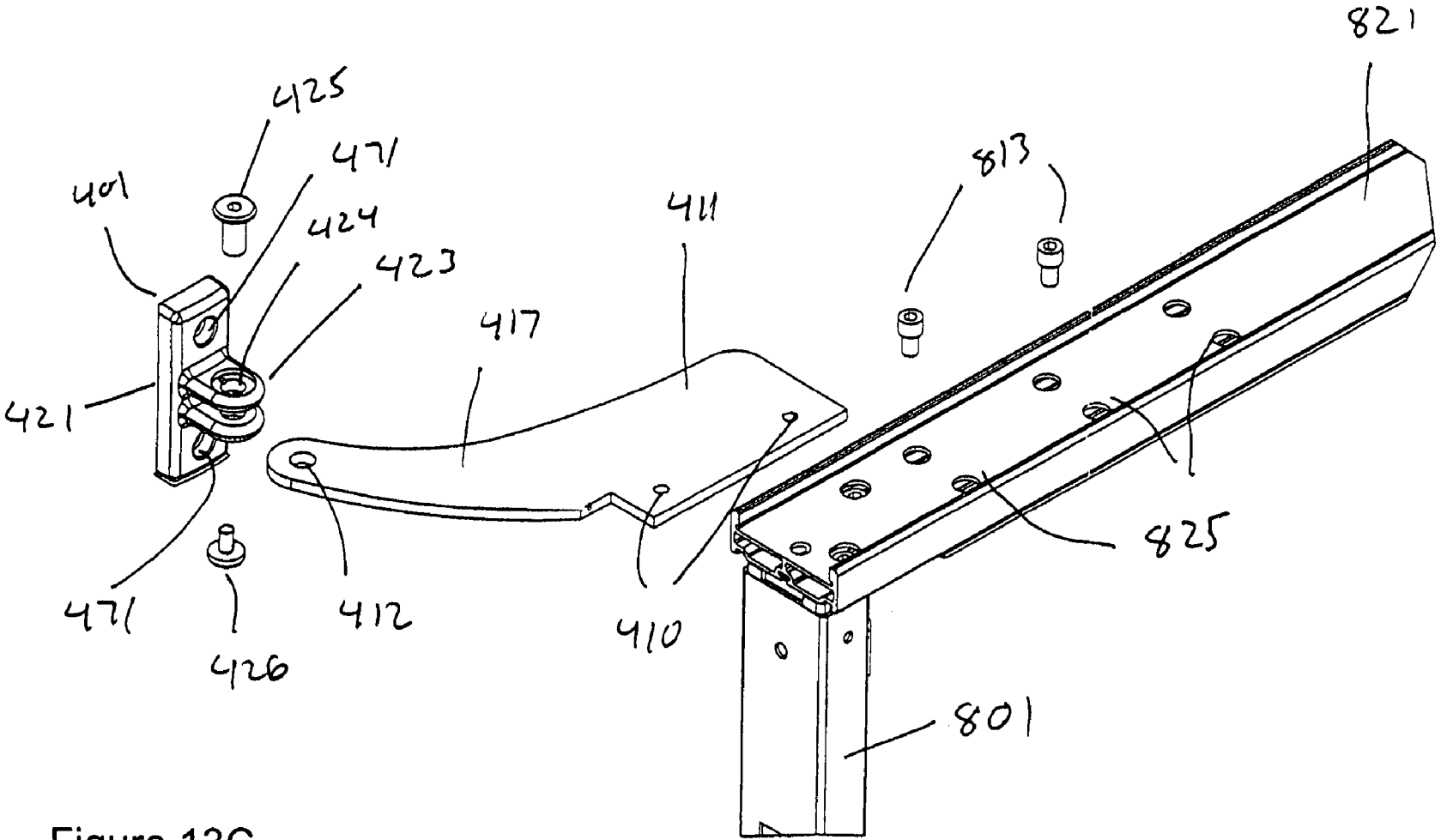
FIG. 13C shows a top connector and a wing wall.

FIG. 13C shows an embodiment of a portion of the spine wall, including connecting member 411, top cap 821, and top mounting member 401. The mounting member 401 includes a base portion 421 and an extending portion 423. The connecting member 411 includes a generally straight portion 413 and a generally curved portion 417. The generally straight portion 413 of the connecting member includes a plurality of holes 410 for connection to the spine wall. The generally curved portion 417 includes a hole 412. Fasteners 425 and 426 are disposed in holes 424 in mounting member 401 and hole 412 connecting member 411 to connect the mounting member to the connecting member.

The mode of attachment of the connecting member 411 to spine wall 71 allows the wing wall to be adjusted to various locations along the spine wall. In one embodiment, the connecting member 411 may be positioned at 12" increments along the spine wall.

In one embodiment, the work space system includes an electrical connection for electrically connecting the wing wall and the spine wall. Electrical power to the wing wall is supplied from the spine wall. The electrical connection includes a conduit 433, an electrical strip 435, and electrical connection covers 431 and 435. The interior of wing wall 31 has sufficient extra space to accommodate extra slack in conduit 433. The extra slack allows the electrical connection to be adjustable in length so that the wing wall may be moved from a first location on the spine wall to a second location on the spine wall. The electrical connection covers 431, 437 provide a protected channel for the electrical connection between the spine wall and the wing wall. The electrical connection is used to power electrical outlet 65.

Figure 5A:
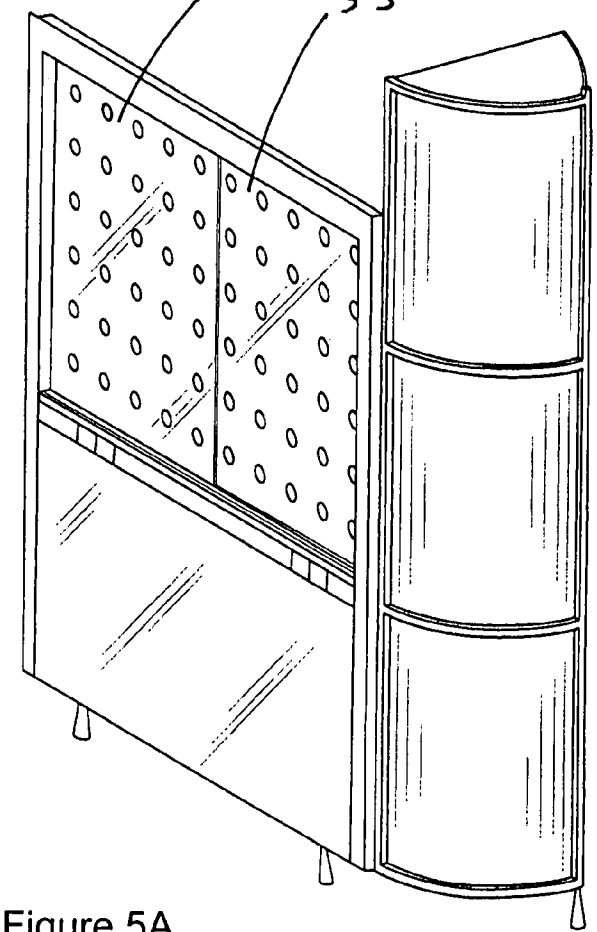
FIG. 5A shows panels in a wing wall in an alternative configuration.
Figure 5:
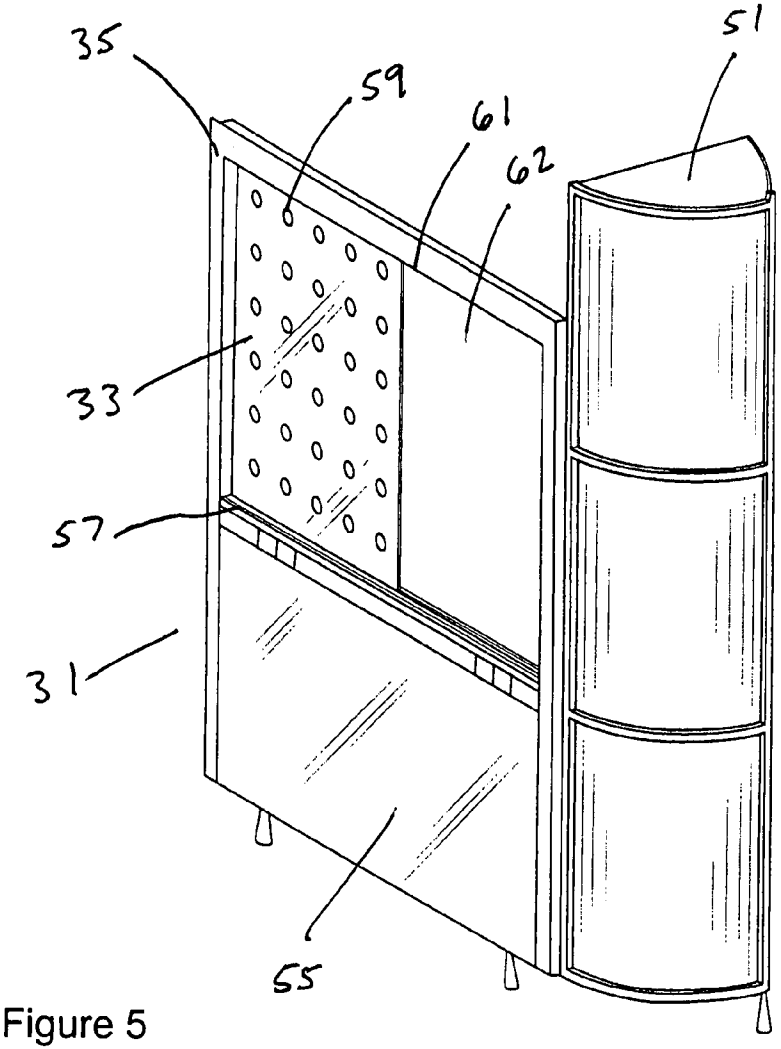
FIG. 5 shows embodiments of panels in a wing wall.

One embodiment of the panels at the top of the wing wall is depicted in FIG. 5 and FIG. 5A. The wing wall 31 has a lower portion 55 and a frame 35 on the upper portion. The frame 55 defines in part an openable area 62. The frame 35 includes a set of tracks 57, 61 for holding panels 33, 53. The panels 33, 53 slide along the tracks 57, 61. Although the frame of the depicted embodiment has two panels, it is to be understood that the scope of the present invention includes other numbers of panels, including one panel and three panels. Each panel 33, 53 can be independently positioned along the tracks 57, 61. Thus, the panels can be in the "open" position shown in FIG. 5, with both panels at one end of the frame 35, or in the "closed" position of FIG. 5A, with one panel at each end of the frame, or anywhere in between. The panels 33, 53 are of sufficient width that the frame 35 is completely closed when the panels are positioned at opposite ends of the frame, as shown in FIG. 5A. The panels may be solid, or may have a pattern of openings, such as the pattern of circular holes 59 shown in FIGS. 5 and 5A. The panels may be made of any suitable material, including wood, plastic, or metal. The panels may also be chosen to have particular optical or acoustical qualities, and may be translucent or opaque. In a preferred embodiment, the panels are made of wood. The panels may be of a variety of colors to enhance the aesthetics of the work area.

FIGS. 6 and 6A depict one embodiment of the top portion of part of the spine wall 71. Positioned at the top of the spine wall 71 is a frame 79. The frame 79 defines in part an openable area 72. The frame 79 comprises track members 85 and 83 at the top and bottom of the frame 79, respectively. Three panels, 73, 75, and 77, are positioned in the tracks. Although the frame of the depicted embodiment has three panels, it is to be understood that the scope of the present invention includes other numbers of panels, including one, two, or four panels. Each panel is positioned in a separate track in the track members, so that each panel may be independently positioned in the frame.

FIG. 6A depicts an "open" position, with the three panels positioned in parallel so that the frame 79 has the maximum open space. FIG. 6 depicts the "closed" position, with the panels positioned end-to-end within the frame 79. The panels may be positioned anywhere between the open and closed positions. The panels are 73, 75, and 77 are of sufficient width that the frame 79 is completely closed when the panels are positioned end-to-end. The panels may be solid as shown in FIGS. 6 and 6A, or may have a pattern of openings, such as the pattern of circular holes shown in FIG. 15B. The panels may be made of any suitable material, including wood, plastic, or metal. The panels may also be chosen to have particular optical or acoustical qualities, and may be translucent, or opaque. In a preferred embodiment, the panels are made of wood. The panels may be of a variety of colors to enhance the aesthetics of the work area.

In another embodiment of the spine wall, there is no frame or panels disposed on the top of the wall, and the top of the spine wall has a cap.

Figure 15A:
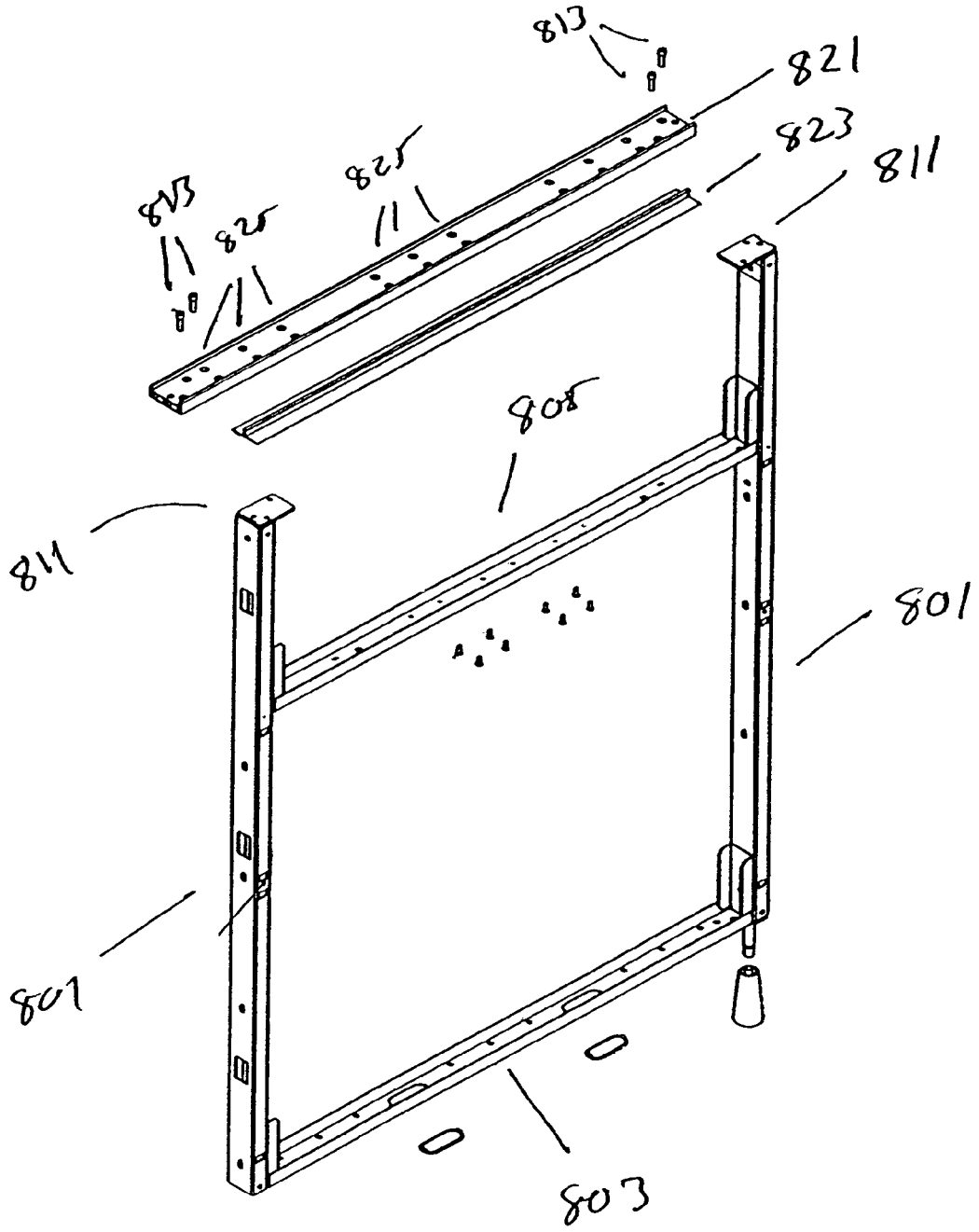
FIG. 15A shows the interior of a spine wall.
Figure 15B:
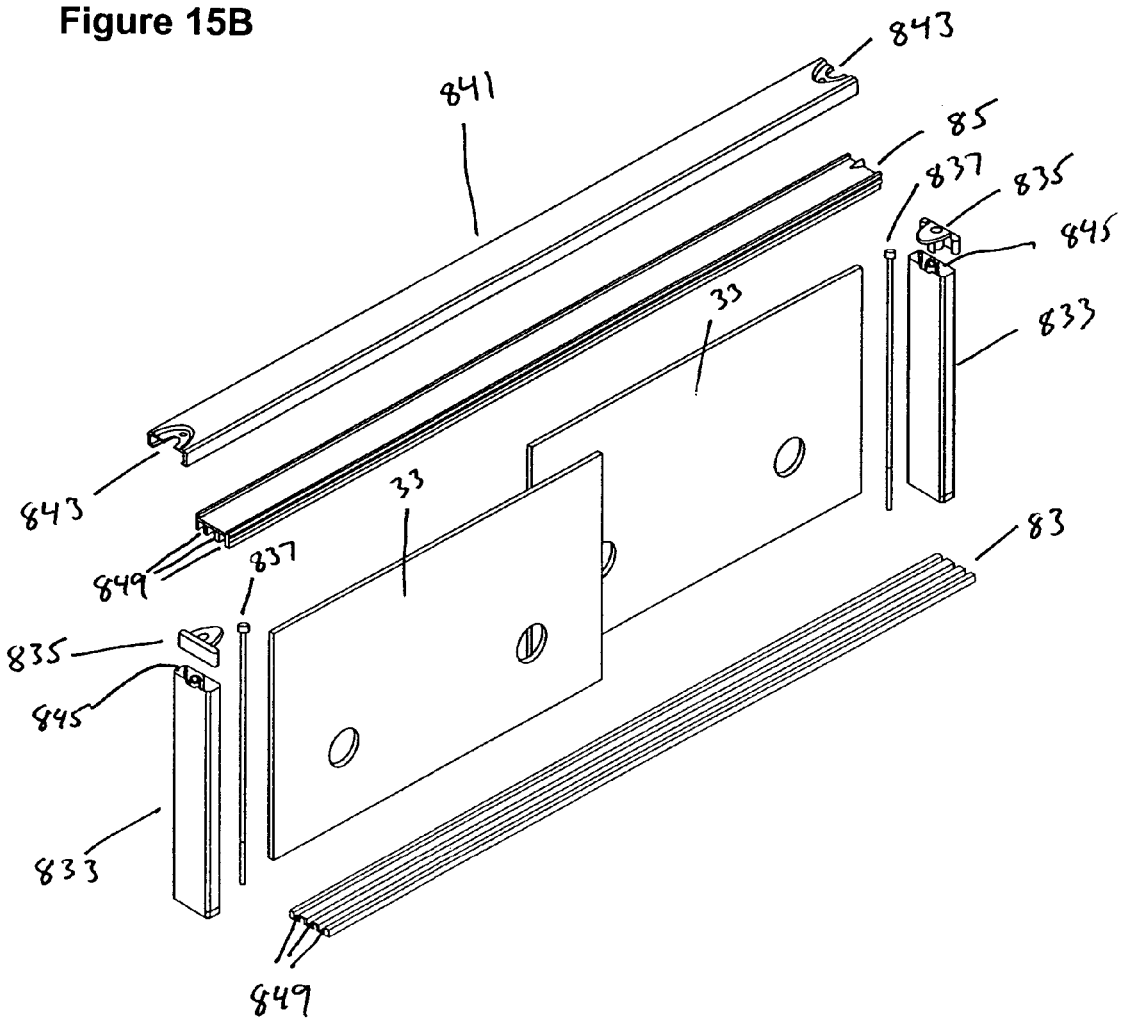
FIG. 15B shows a top portion of a spine wall.
Figure 15C:
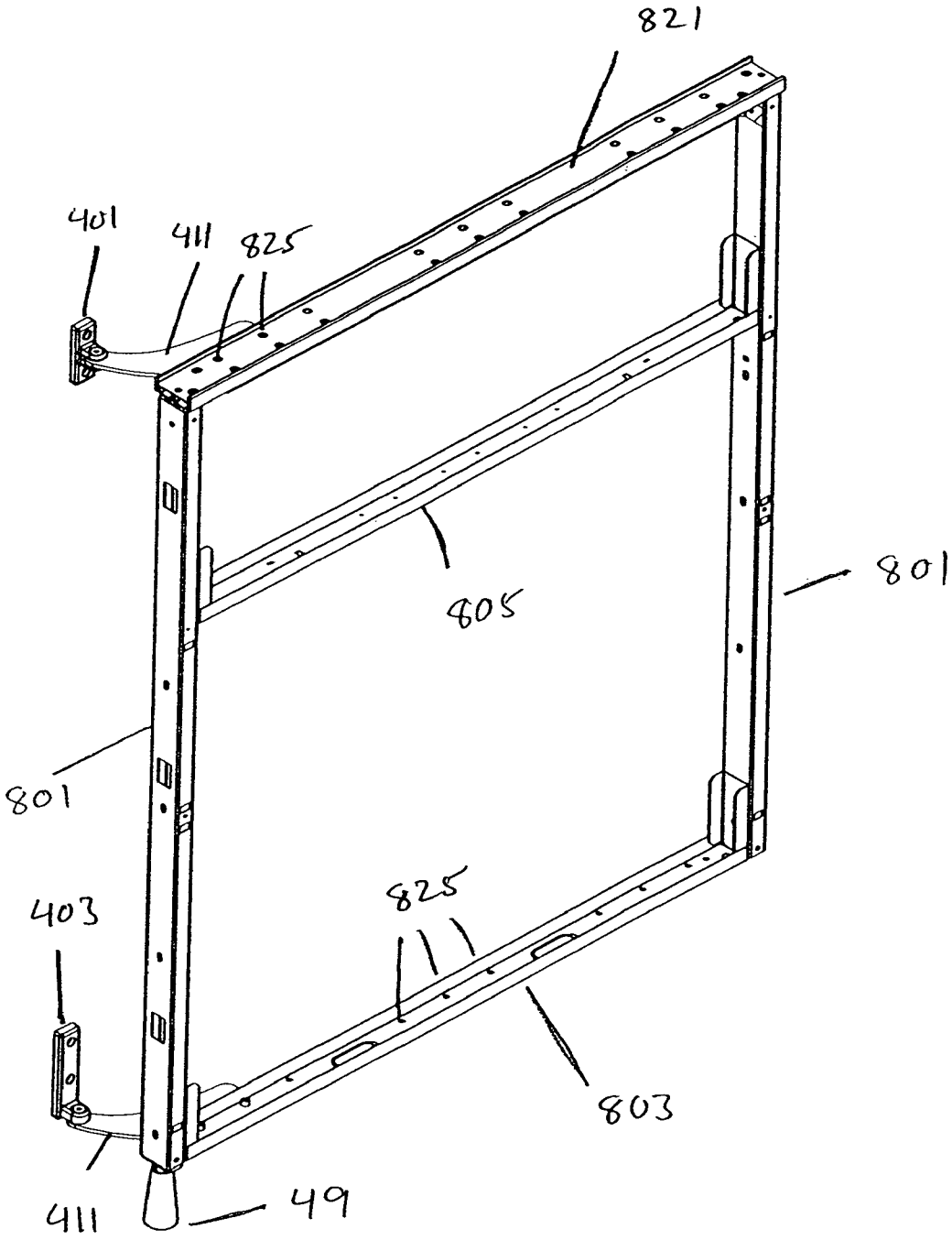
FIG. 15C shows the interior of a spine wall and a wall connector.

In one embodiment, the spine wall has an internal frame structure shown in FIGS. 15A and 15C. The lower portion of the spine wall includes two vertical frame members 801, a lower horizontal frame member 803, and an upper horizontal frame member 805. The components of the frame may be connected by any conventional method including welding and mechanically fastening. Each vertical frame member includes a horizontal plate 811 attached near the top. The horizontal plates 811 provide points of attachment for top cap 821. In one embodiment, top cap 821 is connected to horizontal plates 811 by fasteners 813. Other methods of attachment such as welding are also possible. The top cap 821 includes a plurality of holes 825. These holes 825 provide points of attachment for the connecting member 411 of the connector between the spine wall and the wing wall. In one embodiment, pairs of holes 825 are used to attach the connecting member 411. As shown in FIGS. 13C and 15C, upper connecting member 411 is disposed under top cap 821 with fasteners 813 disposed through holes 825 and 410 to secure the connecting member to the top cap 821. The lower connecting member 411 is attached to lower horizontal frame member 803 in a similar fashion. The pattern of holes 825 is repeated at intervals along the length of top cap 821 and lower horizontal frame member 803 to provide adjustable attachment points for the wing wall. A light seal 823 is disposed below the top cap 821 to prevent light leakage between adjacent workspaces.

One embodiment of the frame disposed on top of the spine wall is shown in FIG. 15B. The frame includes two vertical members 833 and horizontal member 841. Vertical members 833 include an internal vertical channel 845. Vertical channel 845 is adapted to hold rod 837. Horizontal member 841 includes two cutouts 843 at each end. Cutout 843 is adapted to receive end cap 835. Rod 837 is disposed through end cap 835 and channel 845 and connects to the top cap 825. Upper track member 85 and lower track member 83 are disposed at the top and bottom, respectively, of the frame. The track members 85 and 83 each include a plurality of tracks 849 to guide the panels 33. In one embodiment, the track members each include three tracks, but other numbers of tracks are possible. The frames of adjacent spine walls may be connected at the top of vertical members 833 to prevent any twisting or other lateral movement of the frames.

As shown in FIG. 5, the wing wall 31 has one or more moveable panels 33 positioned in a frame in the top portion of the side wall. FIG. 18A shows an embodiment 501 of the panel 33 in the wing wall. The top of the panel 501 is secured to the frame of the wing wall with a pair of roller assemblies 511. A roller assembly 511 is shown in greater detail in FIG. 18B. The roller assembly has a base 513 which is attached to panel 501 by fasteners 515. In one embodiment, the fasteners 515 are screws. The roller assembly has a top support 517 which holds a wheel 519 on an axle 541. A side view of the roller assembly and frame assembly 521 is shown in FIG. 18C. The roller assembly is supported by a track 531 in a frame assembly 521. The track has a bottom 529 and a top 525. The wheel 519 rolls along the track 531, allowing the panel to move in the horizontal direction. A top ridge 523 and bottom ridge 533 help prevent the roller from becoming dislodged from the track 531. The panel may be removed by a user by lifting the panel. Wheel 519 is lifted upwards into track top 525. The bottom of the wheel then may be moved over ridge 533 and out of track 531. Similar tracks 543 and 545 allow for additional panels to be inserted in the frame assembly 521. In one embodiment, the bottom of the frame has a track assemble for guiding the panels. In one embodiment, the track assembly is made of a plastic extrusion.

Figure 12:
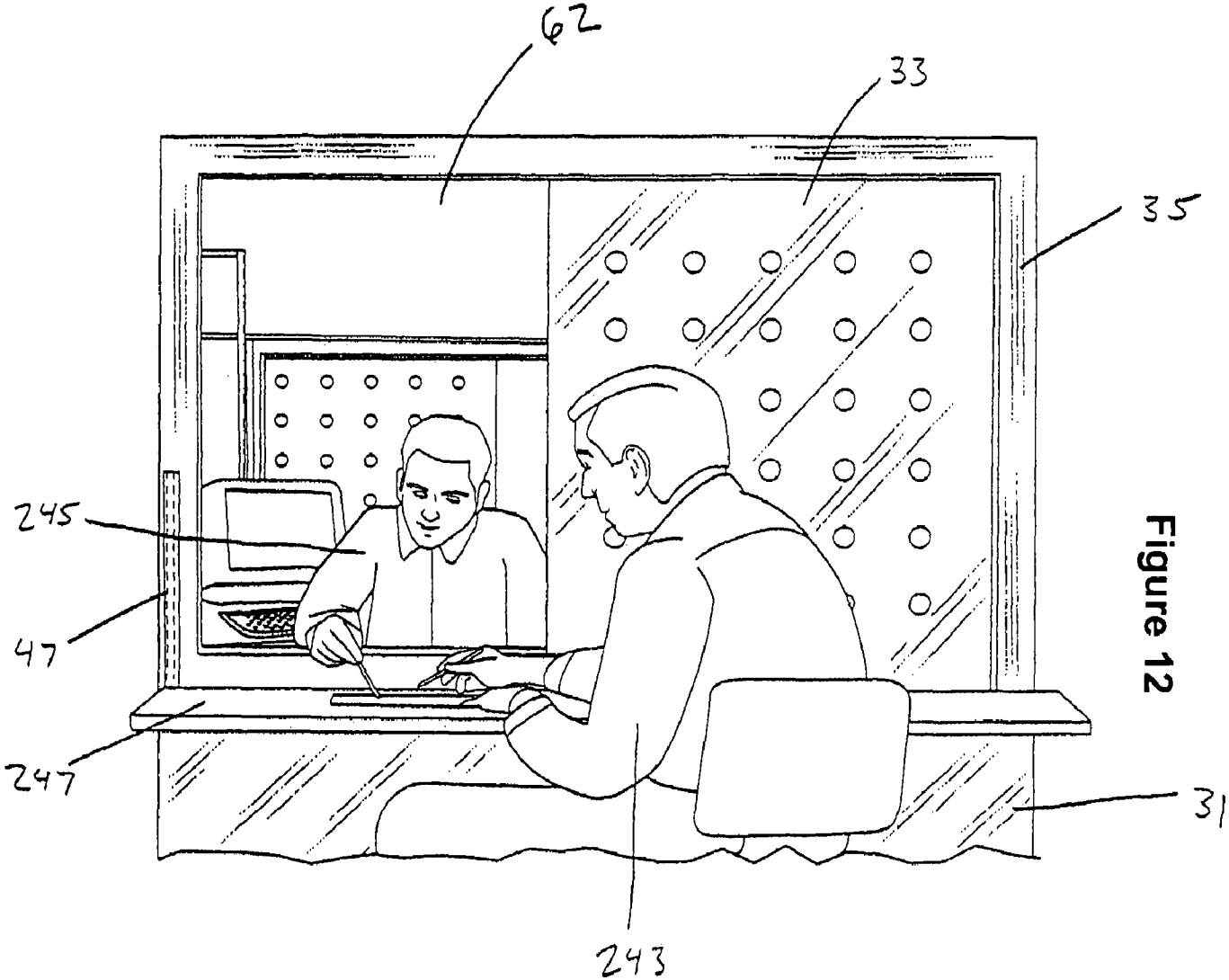
FIG. 12 shows users adjacent to a wing wall.

FIG. 12 shows two users 243, 245 in adjacent work areas interacting through a wing wall 31. Worker 243 sits at work surface 247 adjacent to wing wall 31. The panel 33 is in the "open" position in frame 35, allowing worker 243 to communicate with worker 245 in the adjacent work area. Referring back to FIG. 2A, the worker 243 in the foreground could be sitting in work area 235, and the worker 245 in the background could be sitting in work area 237. As soon as their conversation is over, either user may slide panel 33 to the "closed" position to minimize unwanted intrusion. It can be seen that the work space design allows users to interact more easily than in conventional work space designs.

Figure 7:
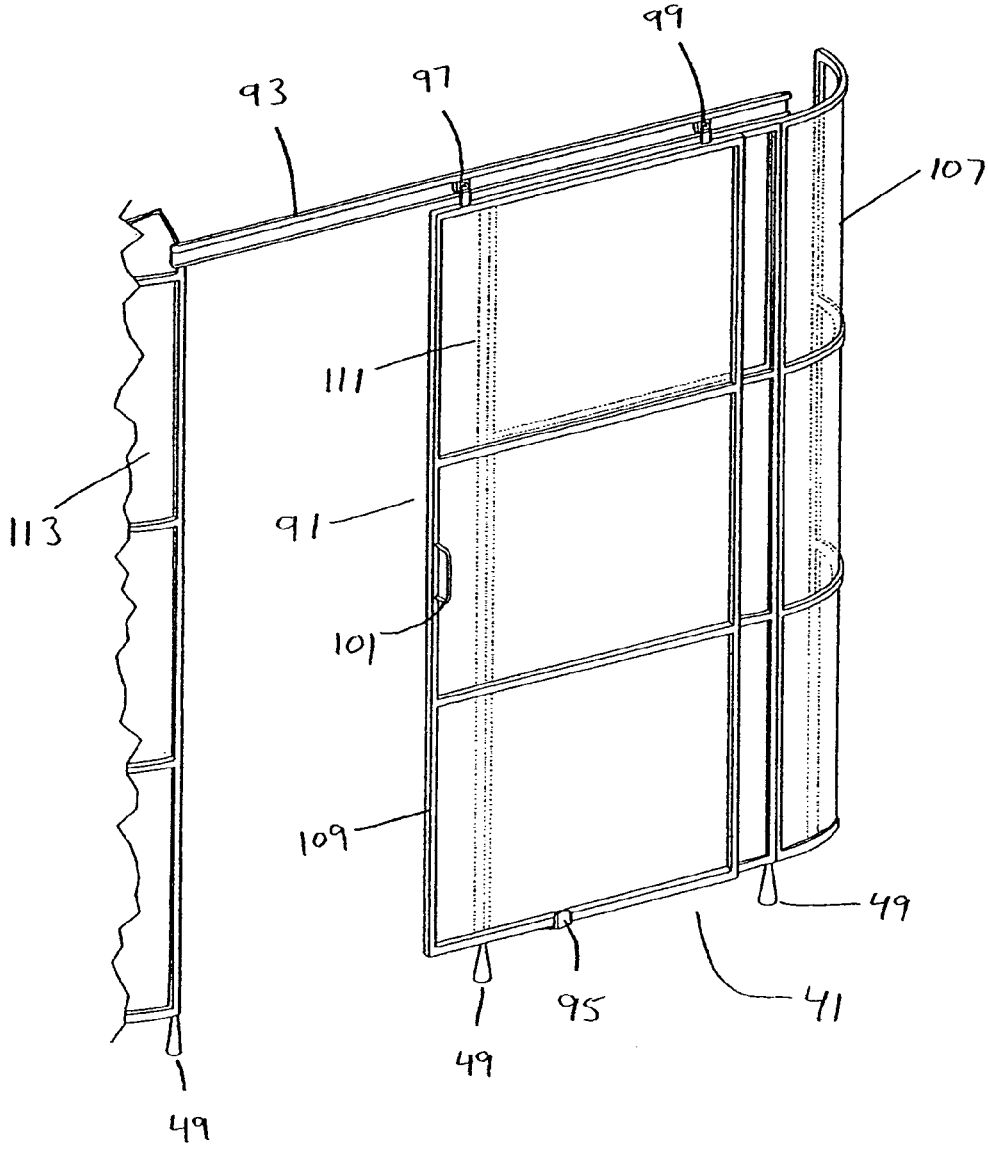
FIG. 7 shows a door assembly.

The entrance of a work space is depicted in FIG. 7. In one embodiment, the entrance of the work space includes a sliding door 91 mounted on the street side wall 41. The entrance to the work area is bounded by a corner piece 113 at one side, a track 93 at the top, and a straight portion 29 of the street side wall 41 at the other side. The track 93 is adapted to hold a pair of wheels 97 and 99, positioned at either end of the top of the door 91. The wheels allow the door to slide along the track from a completely closed position to a completely open position. A guide 95 at the bottom of the street side wall 41 helps to guide the door 91 and keep it in the proper position. A handle 101 facilitates user movement of the door. In one embodiment, the door 91 includes a frame 109 which contains panels 111. In one embodiment, the frame 109 is metal, and the panels 111 are plastic. In one embodiment, the panels 111 are translucent, allowing diffused light to pass through. This allows a person within the work area to have some indication of what is going on outside without being completely exposed. In one embodiment, the corner pieces 107 and 113 and the straight portion 29 of the street side wall 41 also comprise a design with a frame and panels. The panels in the street side wall and the corner pieces may also be translucent.

Figure 7A:
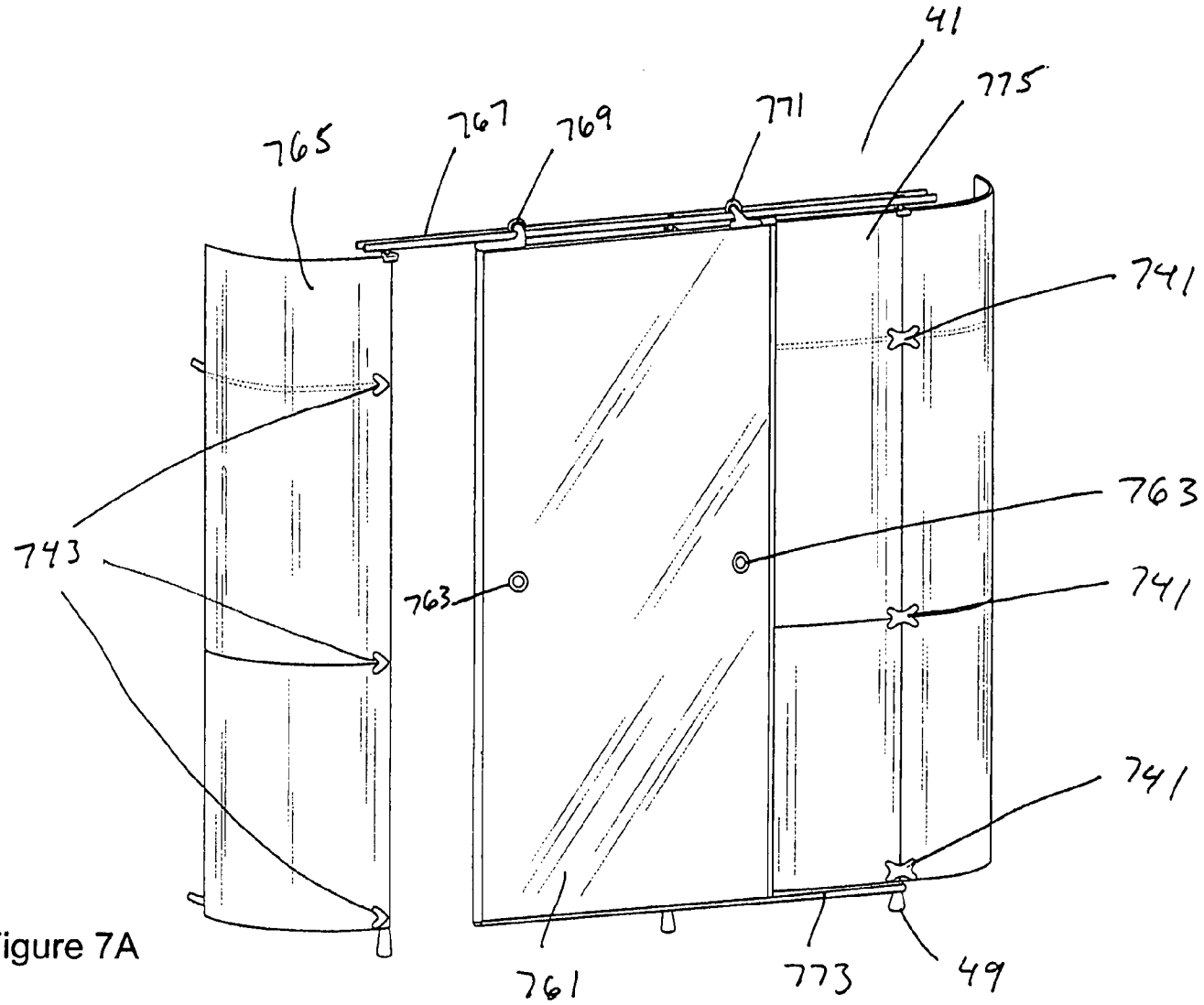
FIG. 7A shows an alternative door assembly.

Another embodiment of the entrance to a work space is depicted in FIG. 7A. The entrance of the work space includes a sliding door 761 mounted on the street side wall 41. The entrance to the work area is bounded by a corner piece 765 at one side, a track 767 at the top, and a straight portion 775 of the street side wall at the other side. The track 767 is adapted to hold a pair of wheels 769 and 771, positioned at either end of the top of the door 761. The wheels allow the door to slide along the track from a completely closed position to a completely open position. A track 773 at the bottom of the street side wall 41 helps to guide the door 761 and keep it in the proper position. A pair of holes 763 facilitate user movement of the door. Cover pieces 741, 743 are disposed on the street side wall, as described below.

Figure 16:
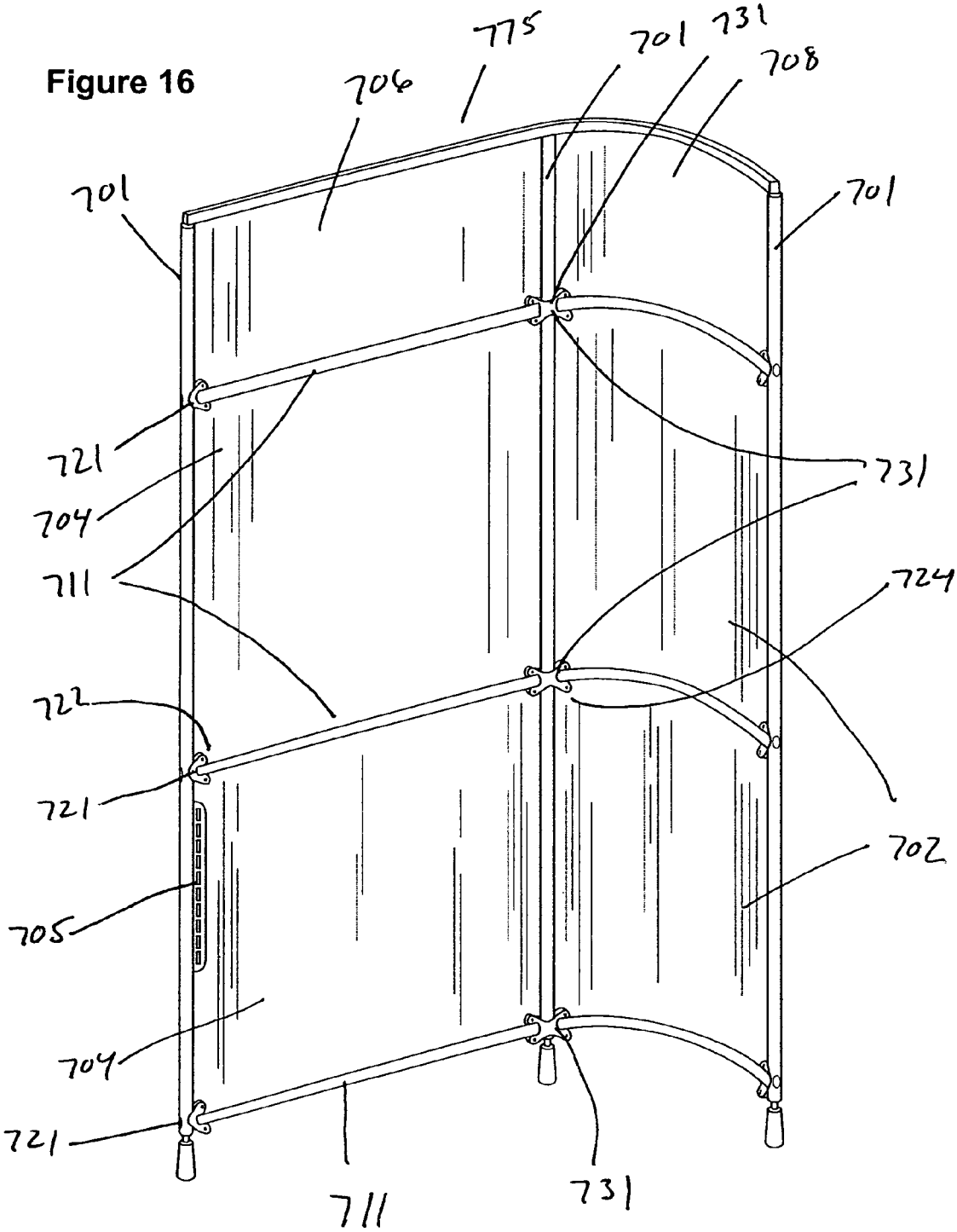
FIG. 16 shows an embodiment of a street side wall assembly.

An embodiment of the street side wall is shown in FIG. 16. The street side wall includes a frame comprising vertical frame members 701 and horizontal frame members 711. In one embodiment, the vertical and horizontal frame members have a hollow tubular shape, but other tube geometries are possible. Flat cladding panels 704, 706 and curved cladding panels 702, 708 are disposed on the frame. In one embodiment, the frame is interior to the work space relative to the cladding panels, but other arrangements are possible. The cladding panels 702, 704, 706, 708 may be translucent or opaque. Connectors 721 (FIG. 17A) and reinforcing plates 731 (FIG. 17B) connect the plurality of cladding panels to the frame. The connectors 721 and reinforcing plates 731 are positioned at the intersection of horizontal and vertical frame members. A vertically slotted member 705 provides a point of attachment for a work surface support frame, such as those shown in FIGS. 14 and 14E.

Figure 17A:
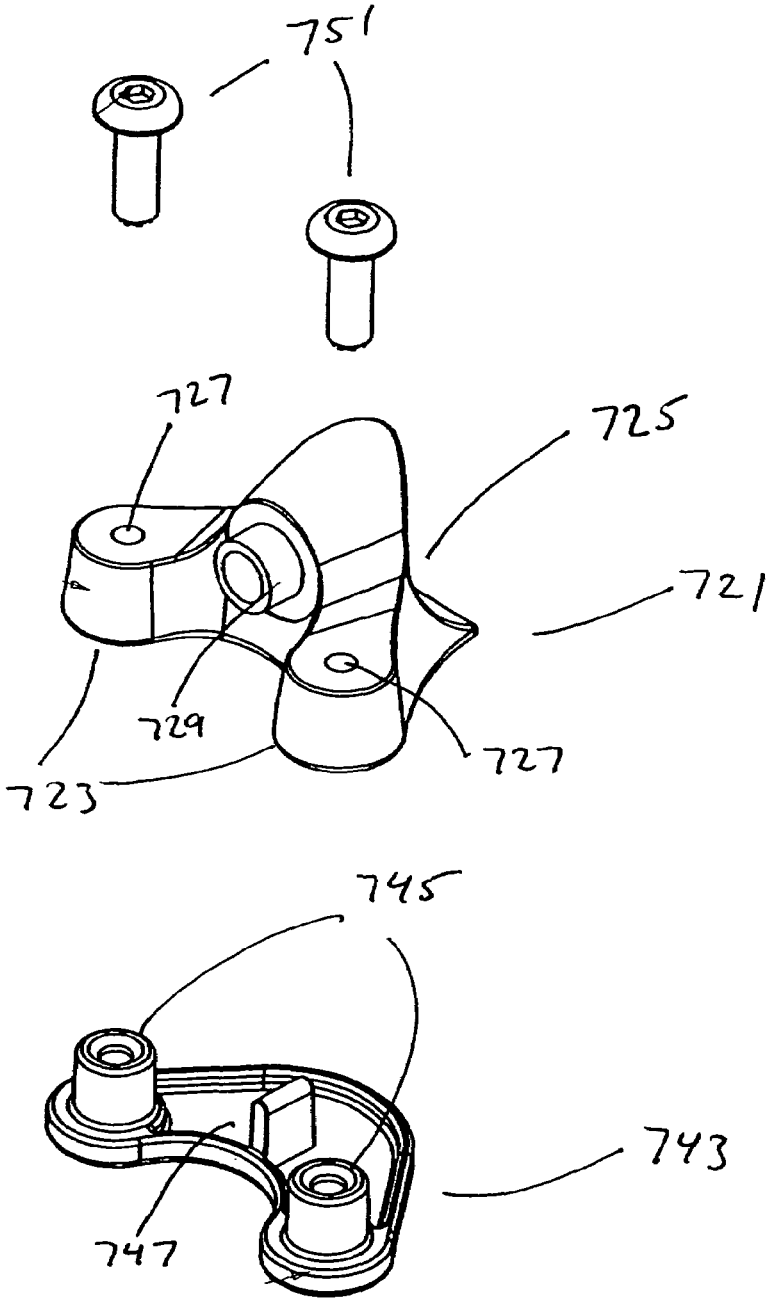
FIG. 17A shows embodiments of street side wall connectors.
Figure 17B:
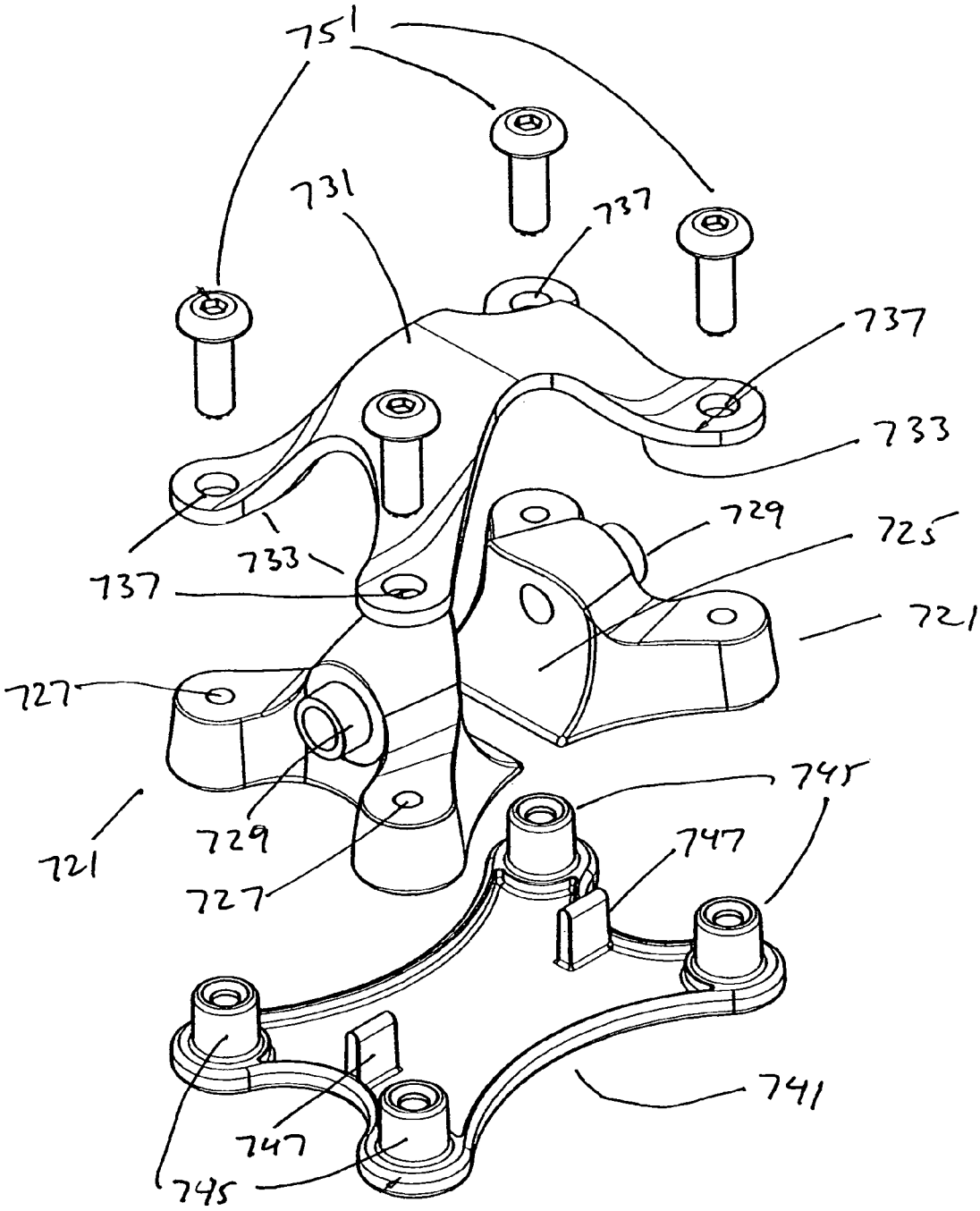
FIG. 17B shows embodiments of street side wall connectors.

In one embodiment shown in FIGS. 17A and 17B, each connector comprises a base element 721 disposed on either the inner surface or the outer surface of the cladding panel. The base element includes two arms 723 with holes 727. The holes are adapted to receive fasteners 751. The base element also includes a concave portion 725 adapted to receive a portion of the side surface of a vertical frame member 701. The base element includes a tubular hub 729 which fits within the interior of a horizontal frame member and secures it thereto. Where one horizontal frame member intersects a vertical frame member, for example at the horizontal edge of the street side wall (722 in FIG. 16), one base element 721 is used. Where two horizontal frame members intersect, for example in the middle of a panel (724 in FIG. 16), two base elements 721 are used, one disposed on each side of the vertical frame member. The two base elements together comprise four arms in an X-like shape and fasteners 751 are disposed through each arm of the X and through holes in the cladding panel. In one embodiment, the connector may also include a reinforcing plate 731 with arms 733. Reinforcing plate 731 is aligned over the X-like shape and fasteners 751 are disposed through each hole 737 and 727. Reinforcing plate 731 may be used at connections between wall segments and provides added rigidity to the street side wall.

A cover piece 741 or 743 is disposed on the opposite side of the cladding panel from the base element. Cover piece 743 is disposed opposite a single base element. Cover piece 741 is disposed opposite a pair of base elements on each side of a frame member. Each cover piece 741, 743 includes a cylinder 745 which attaches to the end of fastener 751. Each cover piece also has one or more tabs 747 which are adapted to fit in the gap between the cladding panels. In one embodiment, cover pieces 741 and 743 are cosmetic and hide one end of fasteners 751. In another embodiment, cylinders 745 in cover pieces 741, 743 act as receiving members for fasteners 751. In a further embodiment, cylinders 745 are threaded and are adapted to receive threaded fasteners 751.

Other possible embodiments of the connector are not shown and are considered to be within the scope of the invention. The orientation of base elements 721 may be rotated 90° so that concave surface is disposed around horizontal members. Two base elements may be molded as a single piece. Base elements 721 may be connected to reinforcing plate 737 as an integrated piece. Tubular hub 729 may be replaced with a cylinder of a greater diameter than the frame member, and the frame member disposed within the tubular hub.

Figure 8:
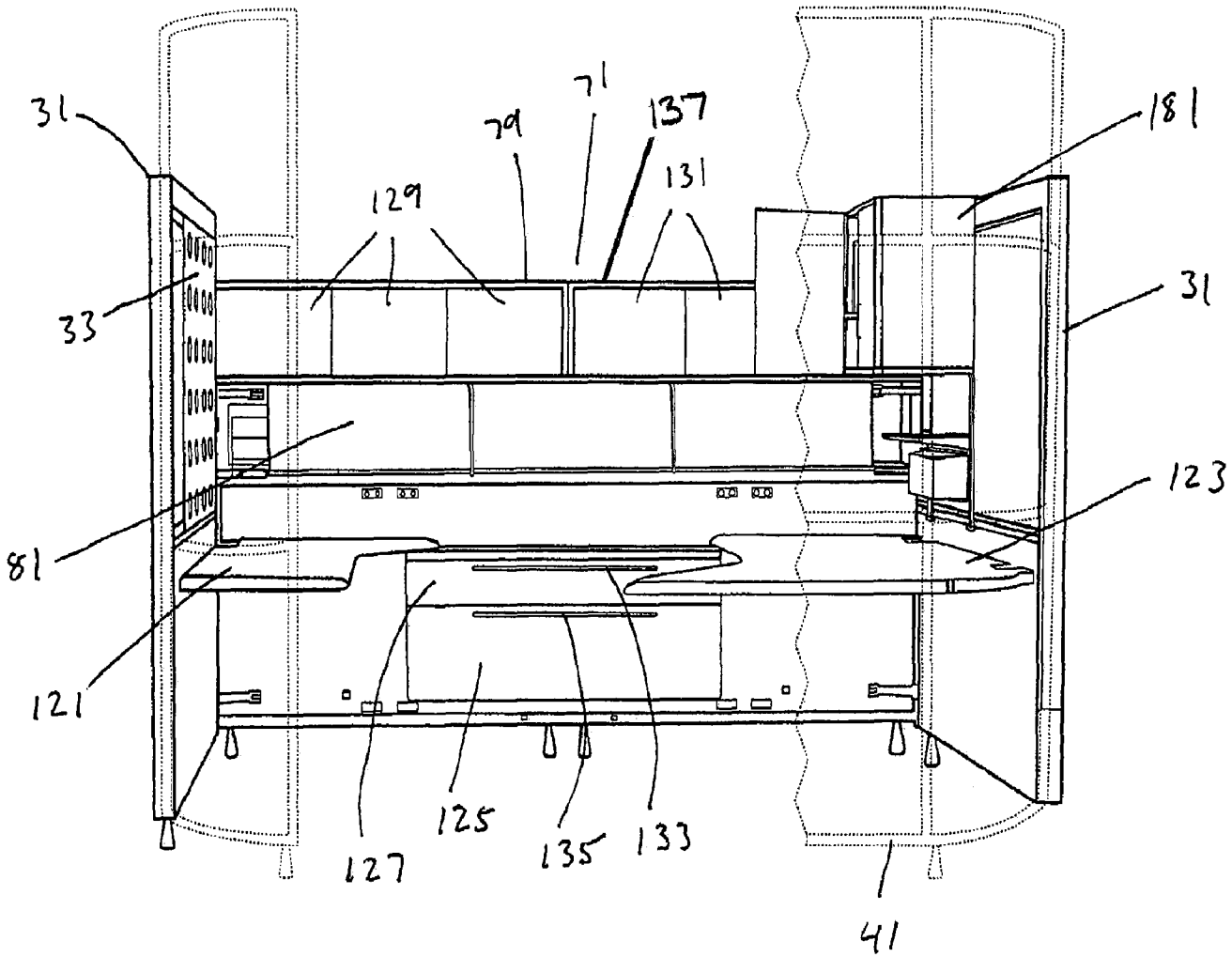
FIG. 8 is a side perspective view of a work area.

FIG. 8 depicts a side view of one embodiment of a work space. To the left and right are wing walls 31, and to the back is spine wall 71. A portion of the street side wall 41 is shown in dotted lines in the foreground. At one end, adjacent to the wing wall, is a work surface 121. At the opposite end of the work space is a work surface 123. The work surfaces 121, 123 are positioned at a height convenient for use by a person sitting in a chair. Disposed between the two work surfaces is a pair of drawers 125, 127. The drawers 125, 127 are of a conventional design. They are adapted to pull out, with handles 133, 135 positioned at the front of the drawers 125, 127. The top portion of the top drawer 127 is lower than the bottom of the work surfaces 121, 123. Disposed at the top portion of the spine wall 71 are two frames 79, 137. In the illustrated embodiment, the frames 79, 137 each have three panels 129, 131. The scope of the present invention includes other arrangements of the frame and the panels, such as having a continuous frame along the spine wall, or different numbers of panels 129, 131 within the frame. Below the frame 79 is a flip-up easel member 81. The shelf has a small lip on the bottom to allow it to hold magazines and similar items. Positioned on one of the wing walls is a movable cabinet 181. The cabinet 181 may be positioned on either wing wall, on both wing walls, or may be absent from a given work space.

Figure 8A:
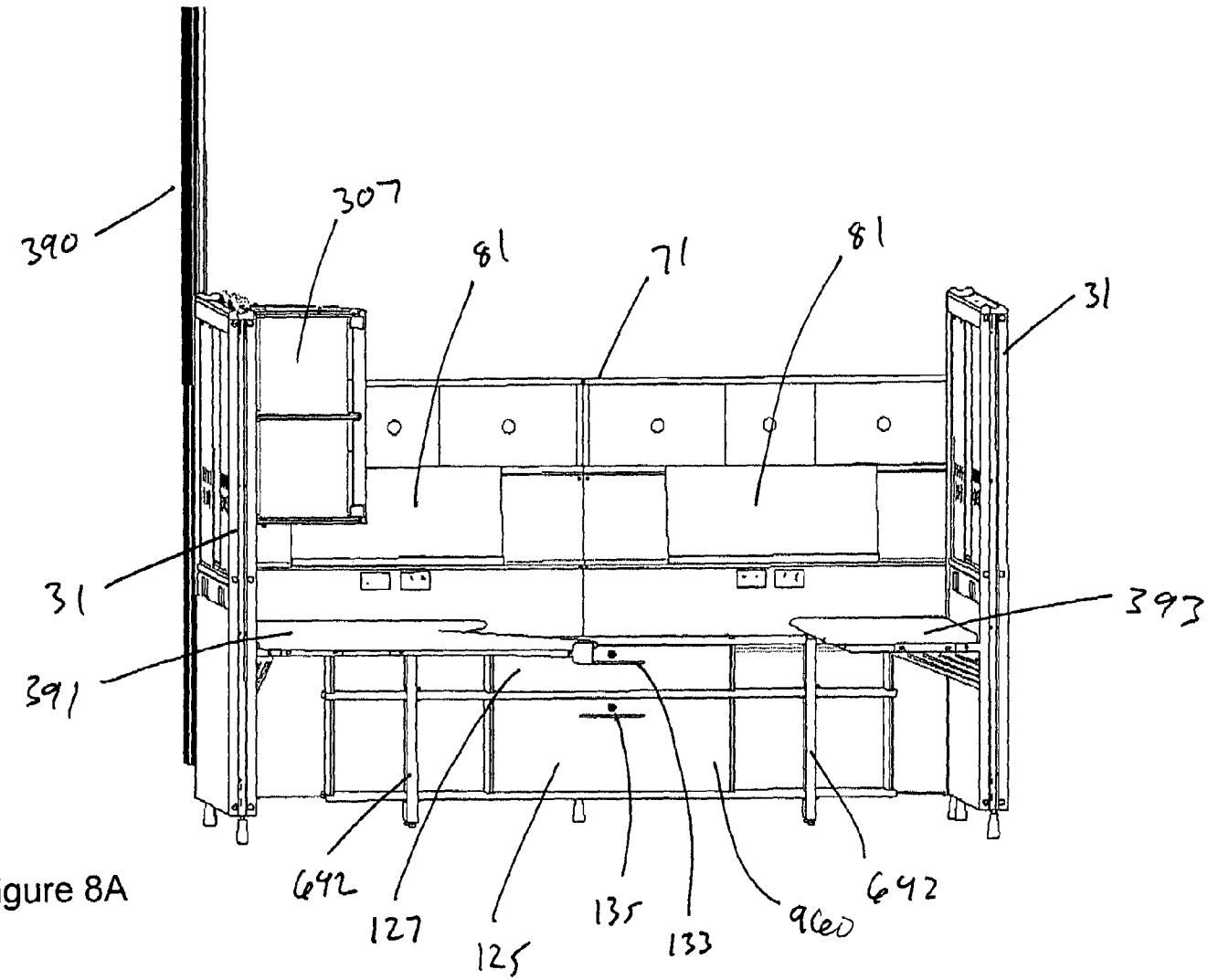
FIG. 8A is a side perspective view of another work area

FIG. 8A depicts a side view of another embodiment of a work space. To the left and right are wing walls 31, and to the back is spine wall 71. Electrical power is supplied to the spine wall 71 from overhead by electrical line 390. At one end, adjacent to one wing wall, is a work surface 391. At the opposite end of the work space is a work surface 393. The work surfaces 391, 393 are positioned at a height convenient for use by a person sitting in a chair. Attached to the spine wall 71 between the two work surfaces is bookcase assembly 960. Vertical work surface supports 642 are attached to bookcase assembly 960. Bookcase assembly 960 includes a pair of drawers 125, 127. The top portion of the top drawer 127 is lower than the bottom of the work surfaces 391, 393. Positioned on one of the wing walls is a movable cabinet assembly 307. The cabinet assembly 307 may be positioned on either wing wall, on both wing walls, or may be absent from a given work space.

The connection between the work surface support and the bookcase assembly is shown in FIG. 14G. Vertical work surface support 642 is attached to bookcase assembly 960. Connecting member 671 slides into vertical support 642 and connects to member 651. Member 651 fits within end member 657 to secure end member 651 to end piece 655. The work surface support frame includes horizontal beams 610, 612 attached to end piece 655. The support frame may be secured to the wing wall by bracket 630. The connection between the work surface support and the bookcase assembly improves the overall stability and rigidity of the work space system, as it connects together the spine wall, work surface, and the wing wall.

Figure 21A:
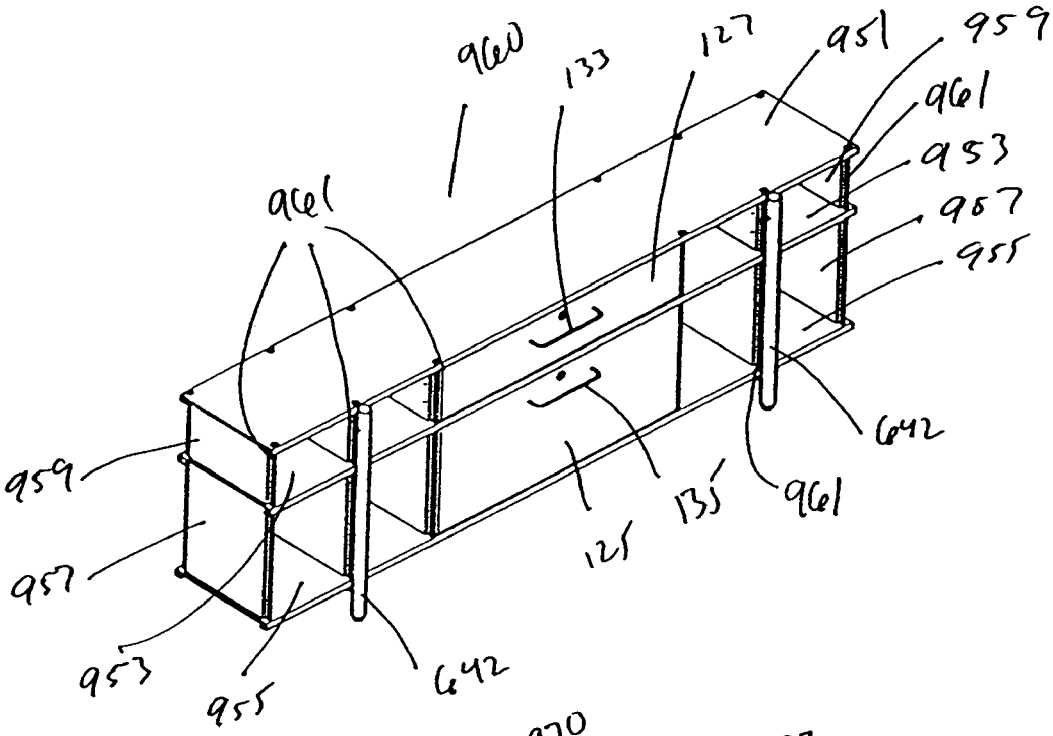
FIG. 21A shows a bookcase assembly.

One embodiment of the bookcase assembly is shown in FIG. 21A. Bookcase assembly 960 includes top surface 951, middle shelf 953, and bottom shelf 955. Vertical members 959 are disposed between the top surface 951 and the middle bottom shelf 953, and vertical members 957 are disposed between the middle shelf 953 and the bottom shelf 955. A plurality of rods 961 are disposed in holes in top surface 951, middle shelf 953, and bottom shelf 955 to secure the cabinet assembly together. A pair of vertical supports 642 are attached to vertical members 957 and 959 as part of the work surface support frame. Drawers 125, 127 are disposed in the center portion of the bookcase assembly. The drawers 125, 127 are of a conventional design. They are adapted to pull out, with handles 133, 135 positioned at the front of the drawers 125, 127.

Figure 21B:
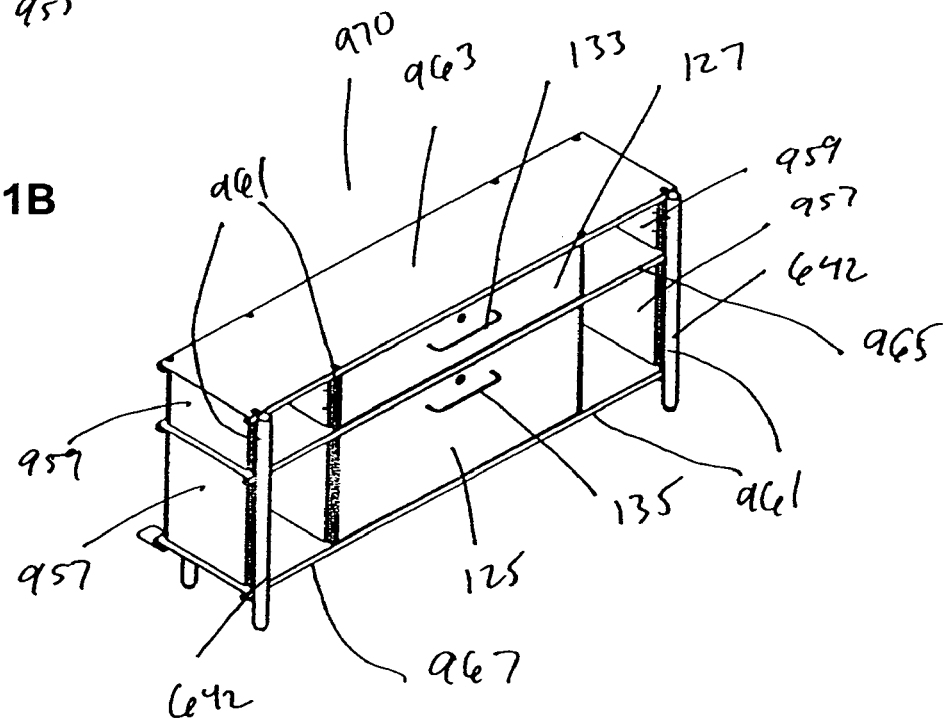
FIG. 21B shows another bookcase assembly.

Another embodiment of the bookcase assembly in shown in FIG. 21B. Bookcase assembly 970 is similar to bookcase assembly 960 except that it is narrower, with one less pair of vertical supports 957 and 959. Bookcase 970 would typically be used in a narrower work area than would bookcase 960.

Figure 10:
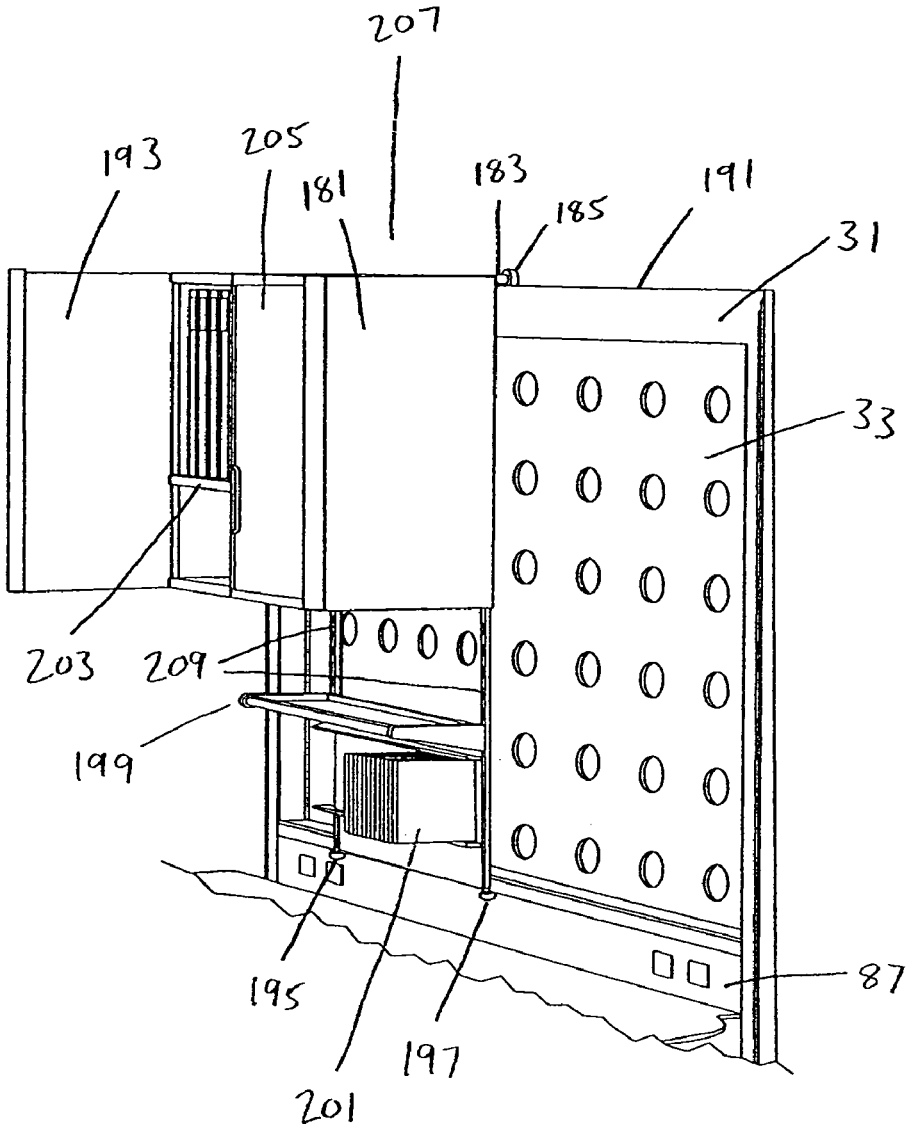
FIG. 10 is a perspective view of a cabinet assembly.

One embodiment of the cabinet assembly 207 is shown in FIG. 10. In one embodiment, the cabinet assembly 207 includes a cabinet 181, support rails 209, a shelf 199, and a compact disk holder 201. The cabinet assembly 207 is adapted to slide along the wing wall 31. Positioned at the top of the wing wall 31 is a track 191. Positioned at the top of cabinet 181 are two wheels 185 (only one wheel is shown). The track 191 is adapted to hold wheels 185. The wheels 185 are connected to the top of the cabinet by axles 183 (only one axle is shown). Disposed at the bottom of the cabinet assembly 207 are two rollers 195, 197. The rollers 195, 197 roll against the wing wall panel 87. Rollers 195, 197 in conjunction with wheels 185 allow the cabinet assembly 207 to be moved horizontally by the user. The cabinet assembly 207 can be moved from one end of the wing wall 31 to another, or positioned anywhere in between. Combined with the wing wall panel 33, the cabinet assembly 207 can be used to open up or close the openable area at the top portion of wing wall 31, depending on the desires of the user.

Figure 10A:
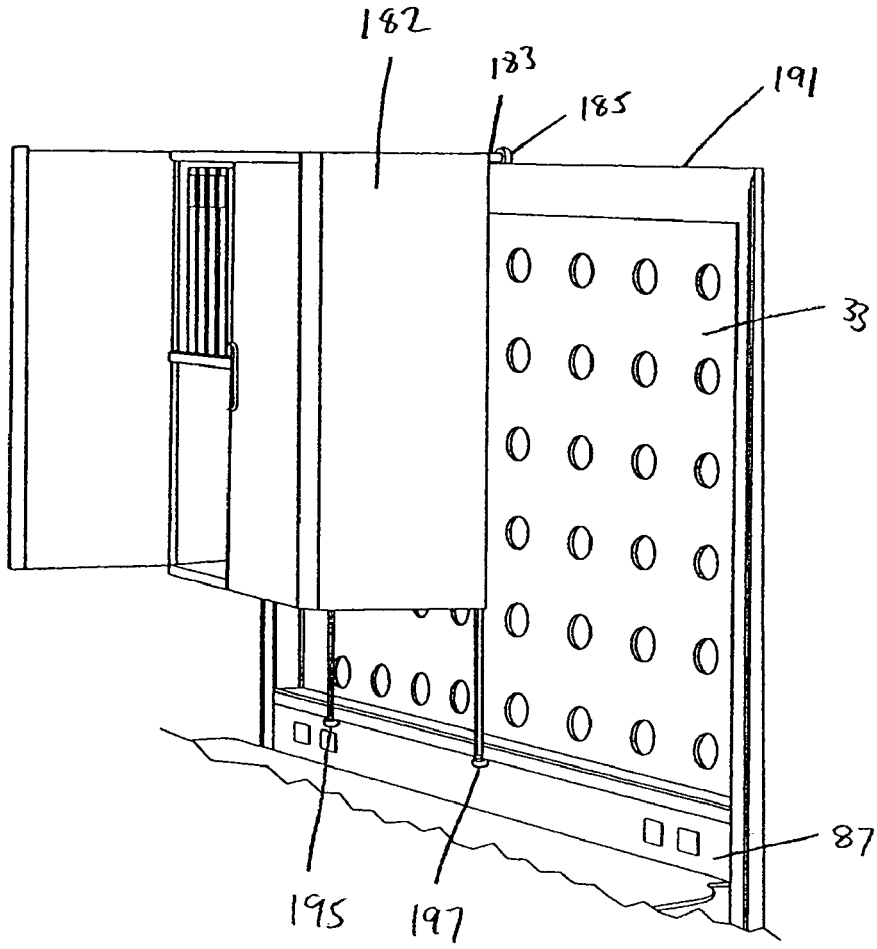
FIG. 10A is a perspective view of an alternative cabinet assembly.

A variety of different arrangements are possible for the cabinet assembly 207. In one embodiment, shown in FIG. 10, a cabinet 181 is positioned at the top of the cabinet assembly 207. The cabinet 181 is of a conventional design, with two doors 193, 205 and an interior shelf 203. Below the cabinet 181 is another shelf 199. Below the shelf 199 is a compact disk holder 201, which is adapted to hold a plurality of compact disks. Another embodiment is depicted in FIG. 10A. This embodiment features a larger cabinet 182, and lacks the shelf and CD holder. In other respects, it is substantially similar to the cabinet assembly depicted in FIG. 10.

An alternative embodiment of a cabinet assembly 307 is shown in FIGS. 19A through 19H. The cabinet assembly 307 may be positioned horizontally along a wall in an off-module manner. A top view of the cabinet assembly 307 in a work area is shown in FIG. 9B. In one embodiment shown in FIG. 19A, the cabinet assembly 307 includes three horizontal panels 311, 313, and 315, a vertical back panel 323, and two vertical side panels 321, 324. The top panel 311, bottom panel 315, and middle panel 313 may be of substantially identical construction. The middle and bottom panels provide a shelf surface for a user to store work materials. In one embodiment shown in FIG. 19D, the panels include a generally flat back edge 361, a generally flat first side edge 363, a generally curved second side edge 365, and a generally curved front edge 367, wherein the second side edge 365 and the front edge 367 form a continuous smooth curved edge. The back edge 361 covers the entire back of the cabinet and a portion 357 wraps part way around the open end.

In one embodiment, a plurality of rods 331 is disposed perpendicular to the planes of the horizontal panels. Each rod has a first end 333, a second end 334, and a middle portion 336. In one embodiment, the rods are threaded. The rod first ends 333 are attached to the top panel 311. The rod second ends 334 are attached to the bottom panel 315. The rod middle portion 336 intersects the middle panel 313. The first and second end portions each includes a fastener which secures the rod in place. The cabinet also includes cabinet support members 341, 343. The support members are disposed on both the top and bottom surface of the cabinet assembly and provide additional structural support. Connected to the cabinet support members are roller support members 351. The roller support members are connected to the cabinet support members by a fastener, such as screws 345.

Figures 19A, 19B:
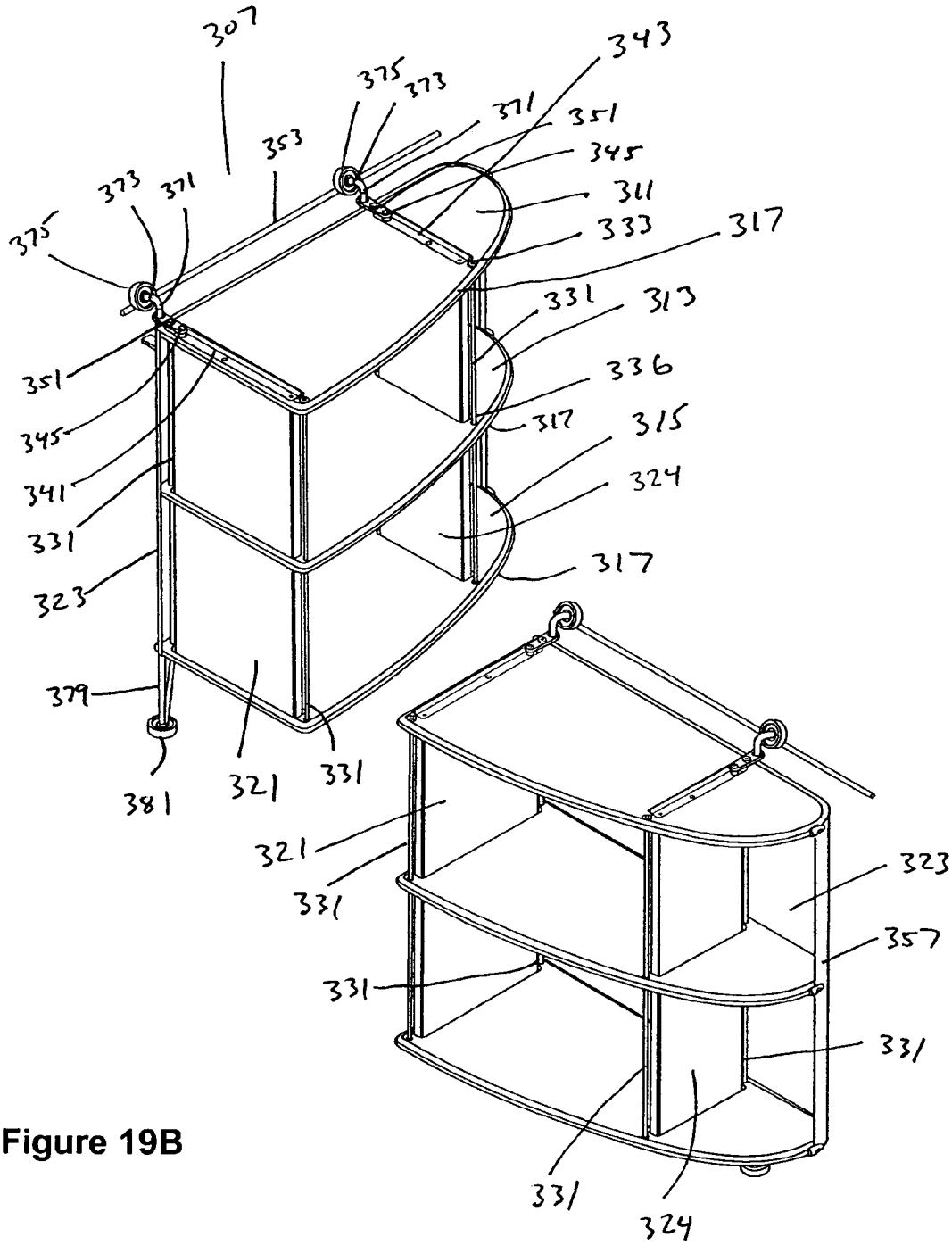
FIG. 19A shows a perspective view of a cabinet assembly.
FIG. 19B shows another perspective view of a cabinet assembly.
Figure 19C:
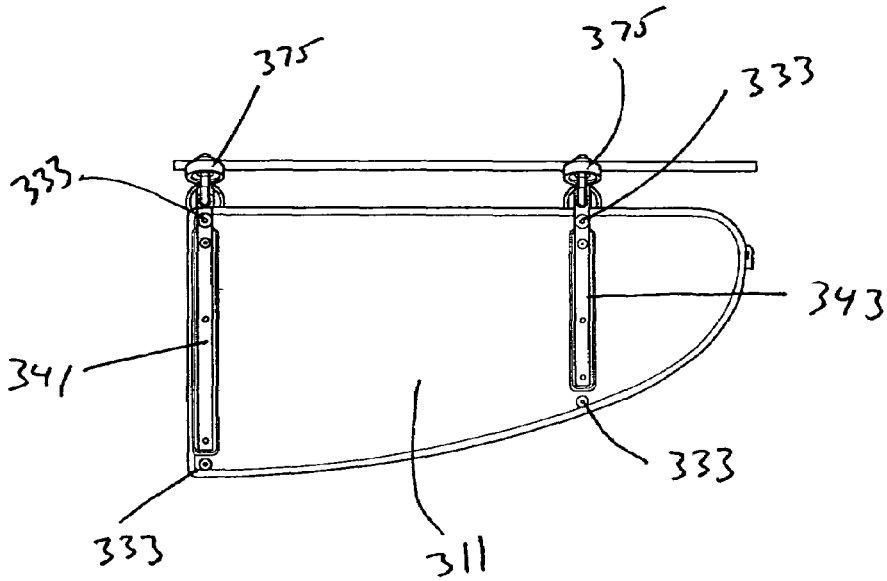
FIG. 19C shows a top view of a cabinet assembly.
Figure 19D:
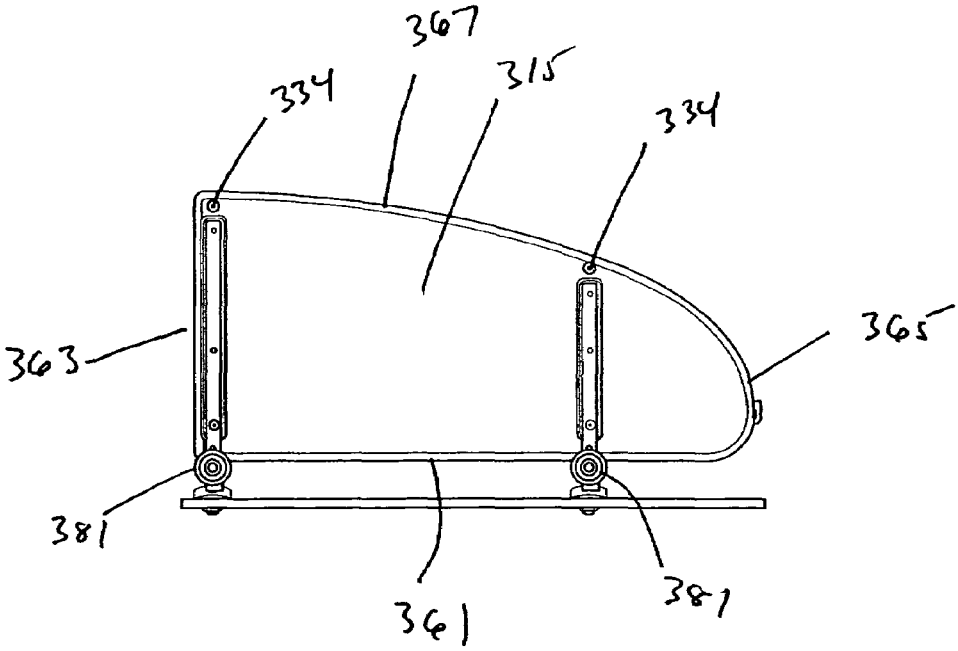
FIG. 19D shows a bottom view of a cabinet assembly.
Figure 19H:
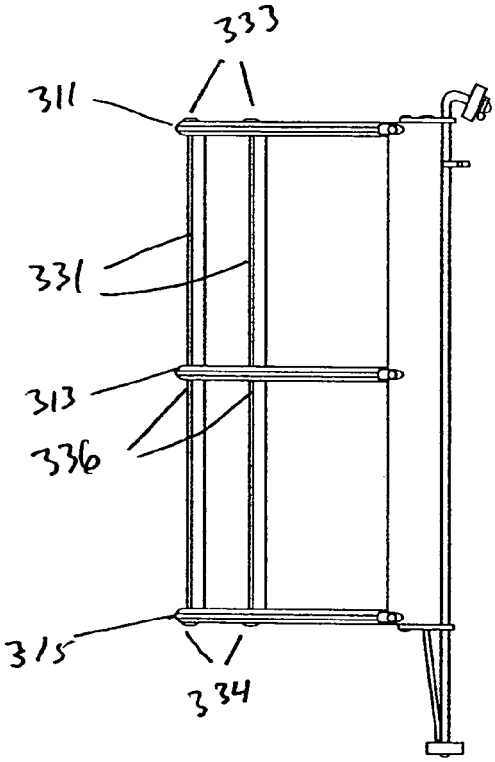
FIG. 19H shows a second side view of a cabinet assembly.
Figure 19F:
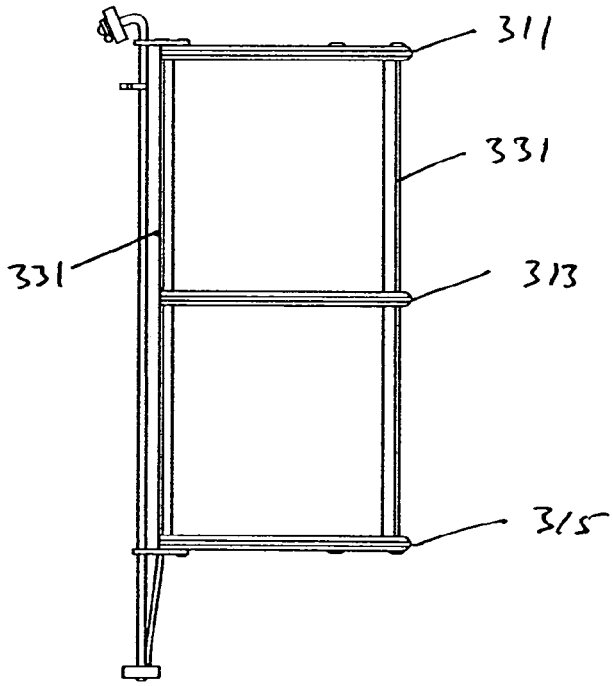
FIG. 19F shows a first side view of a cabinet assembly.

The cabinet assembly 307 is adapted to slide along the wing wall 31. Positioned at the top of the wing wall 31 is a track 191, as shown in FIGS. 9B and 10A. Positioned at the top of cabinet assembly 307 are two wheels 375. The wheels 375 are connected to the top of the cabinet by generally horizontal axles 373. In one embodiment, as shown in FIG. 19A, axles 373 may be oriented slightly downwards from horizontal toward the wheels 375. The generally horizontal axles 373 are connected to the roller support members 351 by arms 371. Positioned at the bottom of the cabinet assembly 307 are two wheels 381. Wheels 381 are rotate about generally vertical axles 379. The wheels 381 roll against the wing wall panel 87. Wheels 375 in conjunction with wheels 381 allow the cabinet assembly 307 to be moved horizontally by the user. A bumper rod 353 connects between axles 373. The bumpers rod stops the travel of the cabinet at the ends of the wing wall.

The cabinet assembly may be positioned so that the generally flat first side edge 363 may be positioned either to the left side or to the right side. The construction of the cabinet assembly is vertically symmetric. The "handedness" of the cabinet can be changed by removing the roller support members 351 and axles 389, flipping the cabinet assembly over, and reattaching the roller support members 351 and axles 389.

As shown in FIG. 9B, in one embodiment the cabinet assembly includes a door 383 that covers part of the width of the cabinet, leaving the remaining portion of the cabinet open. The door 383 is hinged on one of the rods 331.

In one embodiment, the composition of the shelf assembly is as follows. The top panel 311, bottom panel 315, and middle panel 313 are constructed from 2-layer welded sheet metal shelves with an extruded trim strip 317 filling the gap between the shelf halves. The two vertical side panels 321, 324 are powder coated medium density fiberboard. The back panel 323 is sheet metal.

In addition to the embodiments depicted in FIGS. 10, 10A, and 19A-19G, the present invention contemplates other possible rolling shelving and cabinet arrangements. For example, one embodiment could include simple horizontal shelves with no doors or vertical components. Another embodiment could be a rolling flat panel with hooks for hanging items such as tools.

As shown in FIG. 6, easel members 81 are hingedly connected to the spine wall just below the frame 79. Easel member 81 includes a lip 82 disposed at the bottom portion so that the flat surface of the easel member may hold items like magazines. Hinges 80 allow the easel member to be flipped up.

Figure 20A:
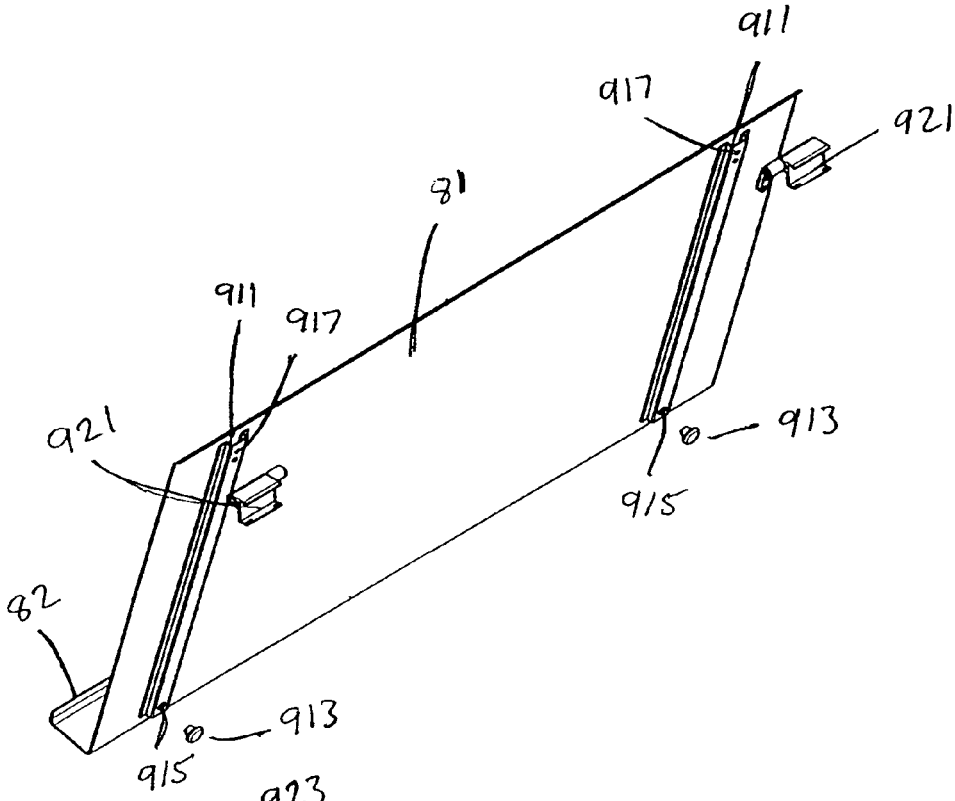
FIG. 20A shows an easel member.
Figure 20B:
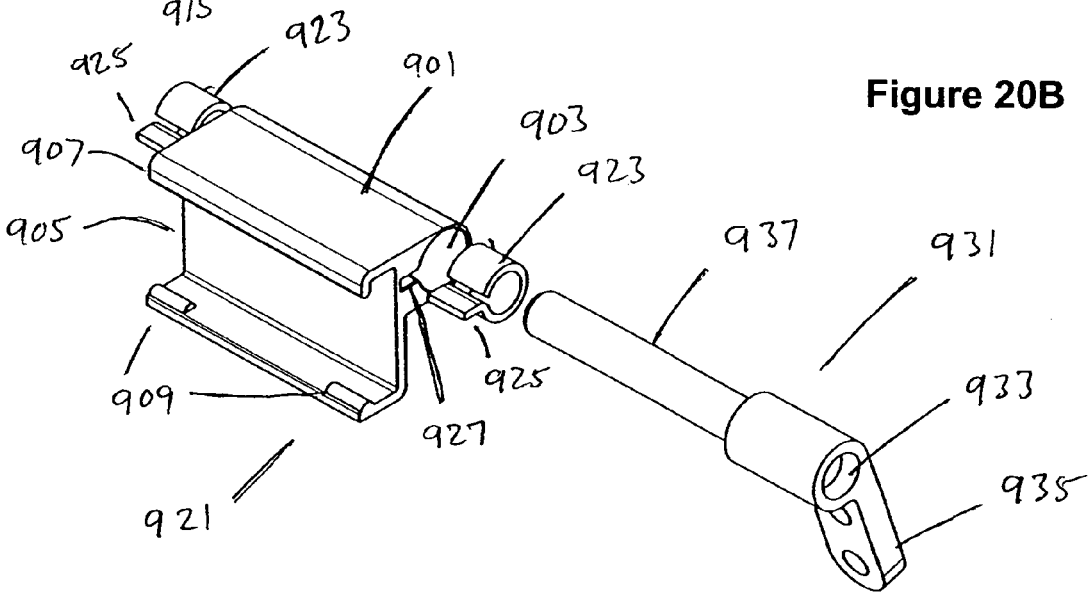
FIG. 20B shows an easel hinge assembly.

FIGS. 20A and 20B show another embodiment of the easel member 81. The easel member 81 is reinforced by support members 911. Support members 911 include holes 915 disposed near the bottom and holes 917 disposed near the top. Hinge assembly 921 includes hinge housing 901, hinge pin 937, bushings 923, and easel connector 931. Easel connector 931 includes a base member 935 adapted to connect to holes 917 in support member 911 with a fastener (not shown). Bushings 923 have flanges 925 which fit into slot 927 in hinge housing 901. Hinge pin 937 is disposed in channel 903 in hinge housing 901 and channel 933 in easel connector 931. Hinge housing 901 includes a square channel 905 which is adapted to fit around the frame portion of a work system wall, with lip 907 and ridges 909 securing the hinge housing around the frame portion. Bumpers 913 are secured in holes 915. In one embodiment, hinge housing 901 is aluminum, bumpers 913 are rubber, and the remaining components are steel.

Figure 11:
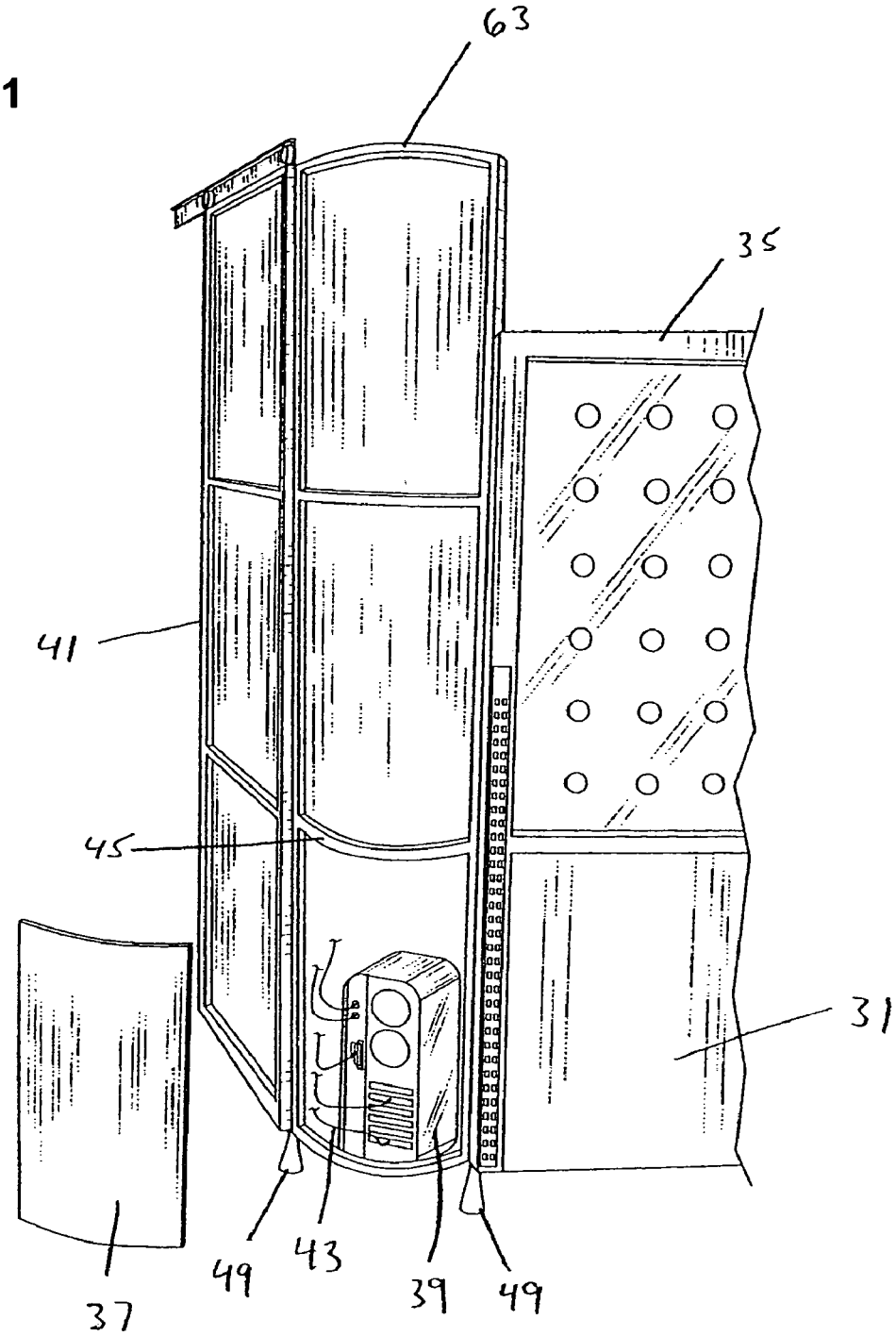
FIG. 11 is a perspective view of an access panel.

FIG. 11 is an enlarged view of an outer corner of a work space. The street side wall 41 and the wing wall 31 meet at a corner piece 63. The corner piece 63 has a curved exterior, which connect the ends of the street side wall 41 and the wing wall 31. The corner piece 63 has a frame 45 which supports a panel 37. The panel 37 may be removed from the exterior of the work space. The panel may be attached to the frame 45 by any conventional method, including screws, a hinge, or an interlocking lip. The existence of the removable panel 37 allows a technician to access the corner of the work area without having to enter the work area or having to crawl under a work surface. For example, a technician can check the operation of a computer 39 by accessing its cables 43 without disturbing the user within. The existence of the access panel also makes it easier to attach peripheral devices such as printers to the computer 39; this can be accomplished without having to drag the computer out from under a work surface or having to physically crawl under a work surface.

Three embodiments of the workspace layout are shown in FIGS. 9, 9A, and 9B. A work space layout in FIG. 9 has a work surface 121 at one end of the work area, positioned adjacent to a wing wall 31. Another work surface 123 is positioned at the opposite end of the work area, adjacent the other wing wall 31. One end of work surface 121 is parallel to the wall towards the entrance 171, and angles into the work area at the end closest to the spine wall 71. The edge of work surface 123 angles from the end closest to the entrance 171 towards the adjacent wing wall 31, and runs parallel to the wing wall 31 at the end closest to the spine wall 71. A worker 163 sits in the work area, with a computer 165 positioned at the end of work surface 123 closest to the entrance 171. Because the worker is facing partially toward the entrance 171, he has a greater ability to see when someone enters his work area to talk to him. Located adjacent the work surface is a storage cabinet 181. There is also a drawer 127 adjacent the work surfaces for storing supplies, files, etc. The work area also has a closet 161 positioned in the corner for storing personal items.

FIG. 9A shows an alternative embodiment of a work space layout. This work space is slightly longer than the work space of FIG. 9 and might be used as a manager's office. The work surface 123 is similar in all respects the standard work surface layout, but in place of work surface 121, there is a work surface 167. Work surface 167 extends out from the spine wall 71 and has an area 173 between it and the wing wall 31. The area 173 can be used for chairs, for example, when the user has visitors. The other features of the larger work area are substantially the same as for the standard work area depicted in FIG. 9, with options for a cabinet 181, a drawer 169, and a closet 161.

FIG. 9B shows another embodiment of a work space layout. A work surface 391 is positioned at one end of the work area, adjacent to a wing wall 31. Another work surface 393 is positioned at the opposite end of the work area, adjacent the other wing wall 31. The edge of work surface 391 facing the work area has a first portion 392 and a second portion 394 meeting at an obtuse angle to form a generally concave edge 395. Work surface 393 has a substantially straight edge 396. Located above the work surface 391 is a cabinet assembly 307. Attached to the spine wall are a pair of easel members 81. There is also a drawer 127 adjacent the work surfaces for storing supplies, files, etc. The work area also has a closet 161 positioned in the corner for storing personal items.

The embodiments described above and shown herein are illustrative and not restrictive. In certain cases, materials of construction have not been described; in these cases, it is to be understood that the invention may be made by any known method and of any known material. The scope of the invention is indicated by the claims rather than by the foregoing description and attached drawings. The invention may be embodied in other specific forms without departing from the spirit of the invention. Accordingly, these and any other changes which come within the scope of the claims are intended to be embraced therein.

The invention claimed is:

1. A work space system comprising:

a first work area comprising:

a spine wall;

a first wall adjacent to, and substantially orthogonal with, the spine wall and extending from the spine wall;

a first work surface coupled to the first wall:

a second wall adjacent to the first wall and substantially opposite from the spine wall with the first work surface disposed between the spine wall and the second wall, the second wall including an entrance to the work area and comprising a first door moveable between a closed position wherein the first door is positioned across the entrance to the first work area and an open position wherein the first door is not positioned across the entrance to the first work area, the entrance configured to allow ingress and egress between a non-work area and the first work area when the first door is in the open position; and a third wall adjacent to, and substantially orthogonal with, the spine wall, the third wall being substantially opposite from the first wall and substantially enclosing the work area, wherein a height of the second wall is greater than a height of each of the first and third walls, and the height of each of the first and third walls are greater than the height of the spine wall, and wherein no other structure of the work space system has a height greater than the height of the second wall; and a second work area adjacent to the first work area and sharing the spine wall of the first work area, the second work area having an outer wall opposite the spine wall and including an entrance to the second work area and comprising a second door moveable between a closed position wherein the second door is positioned across the entrance to the second work area and an open position wherein the second door is not positioned across the entrance to the second work area, the entrance to the second work area configured to allow ingress and egress between a non-work area and the second work area when the second door is in the open position, wherein a height of the outer wall is greater than the height of the spine wall and first and second walls.

2. The work space system of claim 1 wherein the second wall comprises a track, the first door sliding along the track substantially parallel to the second wall.

3. The work space system of claim 2 further comprising:

at least one roller disposed at the top of the first door, wherein the track is disposed at the top of the second wall and provides a rolling surface for the roller.

4. The work space system of claim 2 wherein the first door comprises a translucent material.

5. The work space system of claim 1 wherein portions of at least one of the spine wall, the first wall and the second wall comprise a translucent material.

6. The work space system of claim 1 wherein the spine wall is between about three and about five feet high, the first wall is between about five and about seven feet high, and the second wall is between about six and about eight feet high.

7. The work space system of claim 1 wherein the spine wall comprises a communication opening between the adjacent first and second work areas, wherein a user may close the communication opening.

8. The work space system of claim 1 further comprising a third work area adjacent the first work area, the third work area sharing the first wall, wherein the first wall comprises a communication opening between the adjacent first and third work areas, wherein a user may close the communication opening.

9. The work space system of claim 1 further comprising a pair of corner members joining the second wall with the first and third walls of the first work area, wherein the corner members each have a curved outer surface relative to a vertical axis.

* * * * *